US009244379B2

(12) United States Patent
Matsumoto et al.

(10) Patent No.: US 9,244,379 B2
(45) Date of Patent: Jan. 26, 2016

(54) POWDER CONTAINER AND IMAGE FORMING APPARATUS INCORPORATING SAME

(71) Applicants: Junichi Matsumoto, Kanagawa (JP); Tsukuru Kai, Kanagawa (JP); Hiroshi Hosokawa, Kanagawa (JP); Yuzuru Ozawa, Kanagawa (JP); Tadashi Hayakawa, Kanagawa (JP); Makoto Komatsu, Kanagawa (JP)

(72) Inventors: Junichi Matsumoto, Kanagawa (JP); Tsukuru Kai, Kanagawa (JP); Hiroshi Hosokawa, Kanagawa (JP); Yuzuru Ozawa, Kanagawa (JP); Tadashi Hayakawa, Kanagawa (JP); Makoto Komatsu, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 106 days.

(21) Appl. No.: 13/903,507

(22) Filed: May 28, 2013

(65) Prior Publication Data

US 2013/0322927 A1 Dec. 5, 2013

(30) Foreign Application Priority Data

Jun. 3, 2012 (JP) ..... 2012-126638
May 16, 2013 (JP) ..... 2013-104009

(51) Int. Cl.
*G03G 15/08* (2006.01)

(52) U.S. Cl.
CPC ..... *G03G 15/0839* (2013.01); *G03G 15/0865* (2013.01); *G03G 15/0877* (2013.01); *G03G 15/0879* (2013.01); *G03G 15/0886* (2013.01); *G03G 15/0889* (2013.01)

(58) Field of Classification Search
CPC ..... G03G 15/0839; G03G 15/0889; G03G 15/0865; G03G 2215/085; G03G 2218/0819; G03G 2215/0816
See application file for complete search history.

(56) References Cited

U.S. PATENT DOCUMENTS 5,495,323 A 2/1996 Meetze, Jr.
6,169,864 B1 1/2001 Baxendell et al.

(Continued)

FOREIGN PATENT DOCUMENTS

CN 1510528 A 7/2004
CN 101025592 A 8/2007

(Continued)

OTHER PUBLICATIONS

Combined Chinese Office Action and Search Report issued Jul. 30, 2015 in Patent Application No. 201310202787.5 (with English translation of categories of cited documents).

*Primary Examiner* — David Gray
*Assistant Examiner* — Andrew V Do
(74) *Attorney, Agent, or Firm* — Oblon, McClelland, Maier & Neustadt, L.L.P.

(57) ABSTRACT

A powder container includes a container body to accommodate powder for image forming therein, the container body including an outlet at a bottom thereof through which the powder is supplied to a powder supply device and being detachably attachable to an image forming apparatus, a rotary member, an agitator supported by the rotary member, and a powder receiver to guide a transport tube transporting the powder in the container body into the container body. The powder receiver includes a nozzle receiver opening, an opening-closing member to open and close the nozzle receiver, a container-side biasing member to bias the opening-closing member to close, a container opening-closing member supporter, a step and an end portion to contact first and second contact surfaces of the powder container receiver due to a restorative force of the container-side biasing member upon attachment of the powder container to the powder supply device.

19 Claims, 22 Drawing Sheets

(56) References Cited

U.S. PATENT DOCUMENTS

| | | | | |
|---|---|---|---|---|
| 6,418,290 | B1 * | 7/2002 | Isomura et al. | 399/254 |
| 7,248,825 | B2 | 7/2007 | Nishitani et al. | |
| 2001/0021326 | A1 | 9/2001 | Yanagisawa et al. | |
| 2002/0114646 | A1 | 8/2002 | Sudo et al. | |
| 2004/0131392 | A1 * | 7/2004 | Matsumoto et al. | 399/262 |
| 2004/0223790 | A1 | 11/2004 | Hosokawa et al. | |
| 2004/0247343 | A1 | 12/2004 | Matsumoto et al. | |
| 2005/0281592 | A1 | 12/2005 | Muramatsu et al. | |
| 2007/0077100 | A1 | 4/2007 | Suzuki et al. | |
| 2007/0147902 | A1 | 6/2007 | Taguchi et al. | |
| 2007/0154244 | A1 | 7/2007 | Taguchi et al. | |
| 2009/0297209 | A1 | 12/2009 | Nakajima et al. | |
| 2013/0028631 | A1 * | 1/2013 | Sato | 399/110 |
| 2013/0243491 | A1 | 9/2013 | Nodera et al. | |

FOREIGN PATENT DOCUMENTS

| | | | |
|---|---|---|---|
| CN | 101846927 | A | 9/2010 |
| JP | 7-020705 | | 1/1995 |
| JP | 7-199632 | | 8/1995 |
| JP | 8-220857 | | 8/1996 |
| JP | 9-211977 | | 8/1997 |
| JP | 10-020642 | | 1/1998 |
| JP | 10-254229 | | 9/1998 |
| JP | 2002-202656 | | 7/2002 |
| JP | 2003-233247 | | 8/2003 |
| JP | 2003-241496 | | 8/2003 |
| JP | 2004-012687 | | 1/2004 |
| JP | 2004-280064 | | 10/2004 |
| JP | 2005-193575 | | 7/2005 |
| JP | 2005-221825 | | 8/2005 |
| JP | 2006-072166 | | 3/2006 |
| JP | 2007-140433 | | 6/2007 |
| JP | 2007-178969 | | 7/2007 |
| JP | 2009-276659 | | 11/2009 |

* cited by examiner

POWDER CONTAINER AND IMAGE FORMING APPARATUS INCORPORATING SAME

CROSS-REFERENCE TO RELATED APPLICATIONS

This patent application is based on and claims priority pursuant to 35 U.S.C. §119 to Japanese Patent Application Nos. 2012-126638, filed on Jun. 3, 2012 and 2013-104009, filed on May 16, 2013 in the Japan Patent Office, the entire disclosures of which are hereby incorporated by reference herein.

BACKGROUND

1. Technical Field

Embodiments of the present invention generally relate to a powder container for containing powder such as developer used for image forming, and an image forming apparatus such as a printer, a facsimile machine, a copier, or a multi-functional machine having at least two functions of the printer, the facsimile machine, and the copier, incorporating the powder container.

2. Related Art

As one example of an image forming apparatus that includes a developing device using powder toner to develop an electrostatic latent image formed on an image carrier into a visible image, the toner contained in the developing device is consumed as an image forming operation performed. The known image forming apparatus includes a toner supply device including a toner container serving as a powder container containing toner therein so that the toner supplying device supplies the toner from the toner container to the developing device.

For example, the toner supply device included in the image forming apparatus includes a plug member. The plug member is used to close an opening formed at an end of the toner container to prevent the toner in the toner container from spilling out through the opening during storage or transportation. The plug member is removed when the toner supply device is attached to the image forming apparatus.

A toner container is replaced with a new one when the toner in the toner container is used up. In the case of a toner container having a plug member, once the plug member is removed, the toner remaining in the toner container may spill or fly out of the opening during the replacement. In addition, since a toner container is longer in an axis line direction, an ideal and preferable storage condition for the toner container is that the toner container is stored with its axis line placed horizontal. In contrast, if the toner container is stored in a standing state with the opening facing downward, the toner clumps together due to its own weight around the opening. This phenomenon obstructs toner discharge from the toner container set in a device main body and easily causes unstable toner discharge or transport. Hence, there is a need for a new structure. Further, on attachment of the toner container to the image forming apparatus, the position of the toner container may need to be stable.

If the plug member is removed when replacing with a new toner container, it is likely that toner leaks or scatters. When storing the toner container that extends in an axial direction, it is preferable that an axis of the toner container remains horizontal. However, in a case in which the toner container is stored with the opening facing downward, the toner aggregates along with the aid of its gravity, and therefore prevention of flow of toner at installation of the toner container to the image forming apparatus easily cause unstable toner discharge and transportation.

SUMMARY

The present invention provides a novel powder container including a container body to accommodate powder for image forming therein, the container body including an outlet at a bottom thereof through which the powder is supplied to a powder supply device and being detachably attachable to a container receiver included in an image forming apparatus, a rotary member disposed in an interior of the container body, an agitator supported by the rotary member to rotate by means of a driving force transmitted from the image forming apparatus, and a powder receiver disposed at a lower portion of the container body to guide a transport tube transporting the powder in the container body into the container body. The powder receiver includes a nozzle receiver opening to guide the transport tube to a position below the outlet, an opening-closing member to open and close the nozzle receiver and cause a powder inlet provided to the transport tube ready to receive the powder, a container-side biasing member to bias the opening-closing member in a direction to close the opening-closing member, the direction being opposite to a biasing direction a powder receiver opening-closing member to open and close the opening-closing member blocks the powder inlet, a container opening-closing member supporter to accommodate the opening-closing member and the container-side biasing member and be biased toward the powder receiver opening-closing member, a step to contact a first contact surface of the container receiver due to a restorative force of the container-side biasing member upon attachment of the powder container to the powder supply device, and an end portion to contact a second contact surface of the container receiver due to a restorative force of the container-side biasing member upon attachment of the powder container to the powder supply device.

Further, the present invention provides a novel image forming apparatus including the above-described powder container, a powder supply device including a transfer nozzle having a toner inlet, the powder supply device to be inserted into the powder container to receive and supply powder from the powder container via an outlet of the powder container and the toner inlet, a powder transport path connected to the transfer nozzle and the developing device to transport powder supplied in the transfer nozzle to a powder supplying target, and a container tray to hold the powder container thereon.

BRIEF DESCRIPTION OF THE DRAWINGS

A more complete appreciation of the invention and many of the advantages thereof will be obtained as the same becomes better understood by reference to the following detailed description when considered in connection with the accompanying drawings, wherein.

DETAILED DESCRIPTION

Figure 1:
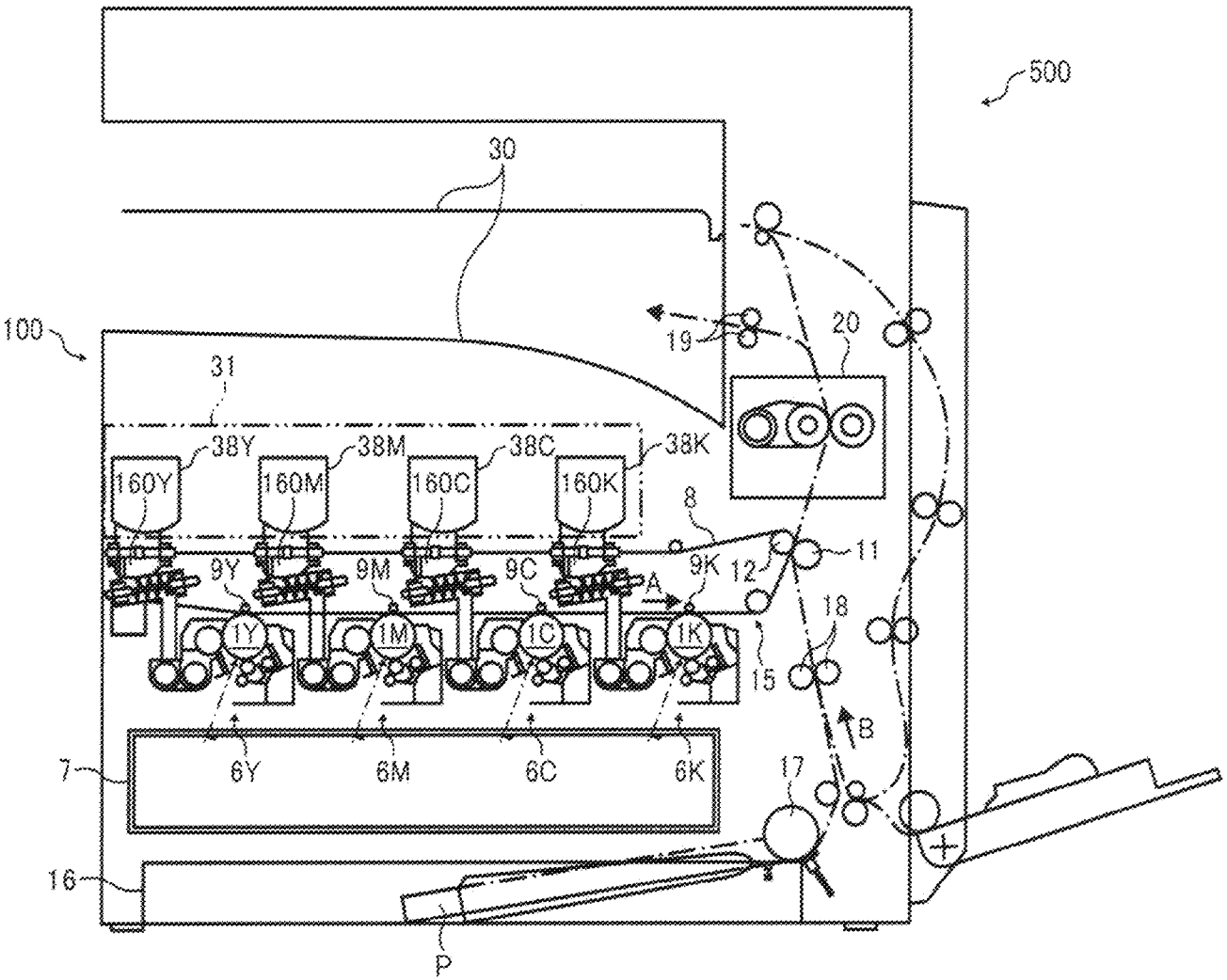
FIG. 1 is a schematic diagram illustrating an example of an image forming apparatus according to an embodiment of the present invention.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used to distinguish one element, component, region, layer or section from another region, layer or section. Thus, a first element, component, region, layer or section discussed below could be termed a second element, component, region, layer or section without departing from the teachings of the present invention.

The terminology used herein is for describing particular embodiments and is not intended to be limiting of exemplary embodiments of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of an image forming apparatus according to exemplary embodiments of the present invention. Elements having the same functions and shapes are denoted by the same reference numerals throughout the specification and redundant descriptions are omitted. Elements that do not demand descriptions may be omitted from the drawings as a matter of convenience. Reference numerals of elements extracted from the patent publications are in parentheses so as to be distinguished from those of exemplary embodiments of the present invention.

The present invention is applicable to any image forming apparatus, and is implemented in the most effective manner in an electrophotographic image forming apparatus.

In describing preferred embodiments illustrated in the drawings, specific terminology is employed for the sake of clarity. However, the disclosure of the present invention is not intended to be limited to the specific terminology so selected and it is to be understood that each specific element includes any and all technical equivalents that have the same function, operate in a similar manner, and achieve a similar result.

Referring now to the drawings, wherein like reference numerals designate identical or corresponding parts throughout the several views, preferred embodiments of the present invention are described.

Figure 2:
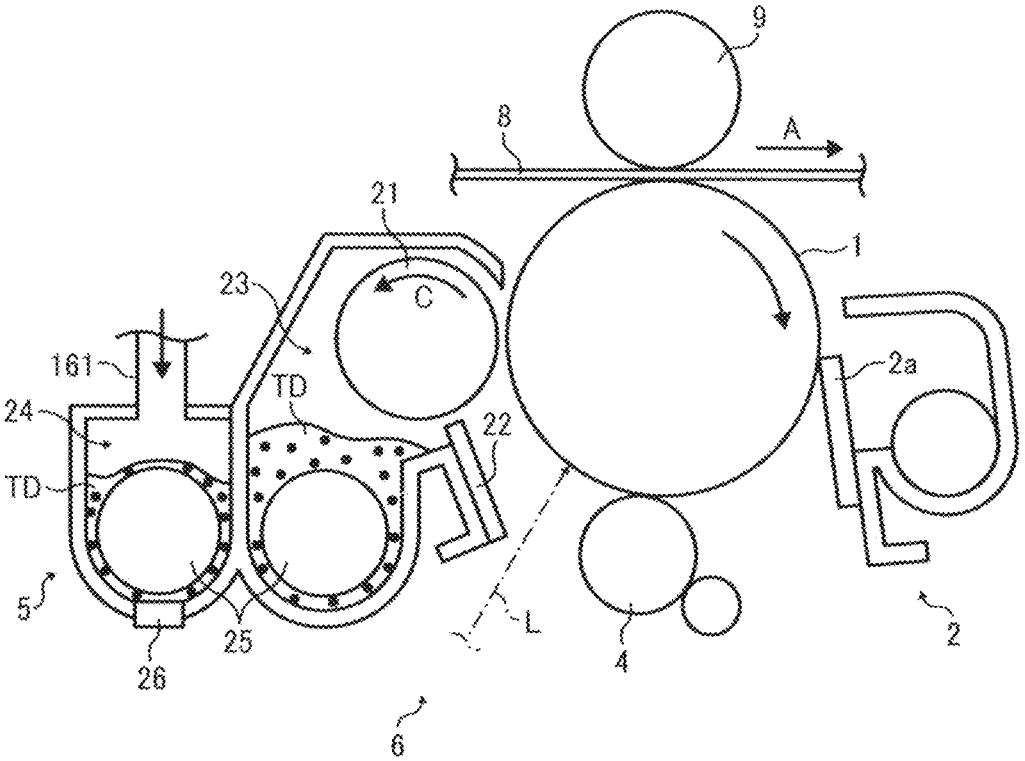
FIG. 2 is an enlarged view illustrating an example of an image forming device included in the image forming apparatus of FIG. 1.

Referring to FIGS. 1 and 2, a description is given of an entire configuration of an image forming apparatus 500 according to an embodiment of the invention.

FIG. 1 illustrates a schematic diagram of the image forming apparatus 500.

As shown in FIG. 1, the image forming apparatus 500 includes a main body 100 that includes a toner container holder 31 serving as a powder container holder, an intermediate transfer device 15, image forming units 6Y, 6M, 6C, and 6K, toner supply devices 160Y, 160M, 160C, and 160K, an exposure unit 7, and a sheet tray 16.

The toner container holder 31 is disposed at an upper portion of the main body 100 of the image forming apparatus 500 and includes four toner containers 38Y, 38M, 38C, and 38K, which serve powder containers for respective colors (yellow, magenta, cyan, and black), each of which is detachable with respect to the toner container holder 31.

The intermediate transfer device 15 is disposed at a lower portion of the main body 100 of the image forming apparatus 500, below the toner container holder 31, and includes an intermediate transfer belt 8. Details of the intermediate transfer device 15 are described later.

The image forming units 6Y, 6M, 6C, and 6K have respective colors corresponding to yellow, magenta, cyan, and black toners and are disposed below the intermediate transfer belt 8 of the intermediate transfer device 15. The image forming units 6Y, 6M, 6C, and 6K are arranged side by side in a line facing an outer surface of the intermediate transfer belt 8 along movement of the intermediate transfer belt 8.

The toner supply devices 160Y, 160M, 160C, and 160K serve as powder supply devices and are disposed a rear part of the main body 100 of the image forming apparatus 500 and are slidably connected to and facing the toner containers 38Y, 38M, 38C, and 38K, respectively.

It is to be noted that members or units for the respective colors (yellow, magenta, cyan, and black) are distinguished by assigning corresponding symbols (Y, M, C, and K).

The toner containers 38Y, 38M, 38C, and 38K contain toners of different colors, which serve as powder for image forming, as described above. When the toner containers 38Y, 38M, 38C, and 38K are attached to the toner container holder 31, the toner supply devices 160Y, 160M, 160C, and 160K facing inside the toner container holder 31 supply or refill the respective color toners to respective developing devices 5.

In this embodiment, elements or components of the image forming devices 6Y, 6M, 6C, and 6K are similar in structure and functions identical to each other except colors of toners, and therefore the configuration of the image forming devices 6Y, 6M, 6C, and 6K is described without symbols.

FIG. 2 is an enlarged view illustrating an example of the image forming device 6 included in the image forming apparatus 500 of FIG. 1.

As illustrated in FIG. 2, the image forming device 6 is configured as a process cartridge including a photoconductor drum 1 (i.e., photoconductor drums 1Y, 1M, 1C, and 1K) serving as an image carrier and components arranged around the photoconductor drum 1 such as a charger 4, a developing unit 5, a cleaning unit 2, and a discharging unit (not illustrated). The image forming device 6 is detachable from the main body 100 of the image forming apparatus 500. The image forming device 6 performs various image forming processes such as a charging process, an exposure process, a development process, transfer processes, and a cleaning process to form a toner image on a surface of the photoconductor drum 1.

In the charging process, the photoconductor drum 1 is rotated by a drive motor (not illustrated) in a clockwise direction in FIG. 2 and the surface thereof is uniformly charged when the surface thereof has come to a position to face the charger 4.

After the charging process, the image forming apparatus 500 performs the exposure process in which the surface of the photoconductor drum 1 moves to a position where the exposure unit 7 disposed below the image forming devices 6Y, 6M, 6C, and 6K emits a laser light beam L to irradiate the surface of the photoconductor drum 1 for forming an electrostatic latent image on the surface thereof.

The surface of the photoconductor drum 1 then reaches a development area where the surface thereof faces the developing unit 5 to develop the electrostatic latent image formed on the surface thereof into a toner image in the development process.

After the development process, the surface of the photoconductor drum 1 reaches a position opposite the intermediate transfer belt 8 and a primary transfer bias roller 9 (i.e., primary transfer bias rollers 9Y, 9M, 9C, and 9K in FIG. 1). At this position, the toner image formed on the surface of the photoconductor drum 1 is transferred onto a surface of the intermediate transfer belt 8, which is a primary transfer process. Even after the transfer of the toner image, some residual toner remains on the surface of the photoconductor drum 1.

After the primary transfer process, the surface of the photoconductor drum 1 comes to a position facing the cleaning unit 2 where the cleaning process is performed to collect the residual toner from the surface of the photoconductor drum 1 mechanically by a cleaning blade 2*a* of the cleaning unit 2.

Thereafter, the surface of the photoconductor drum 1 reaches an opposite position to the discharging unit where residual electric potential is removed from the surface of the photoconductor drum 1.

Thus, a series of image forming processes performed on the surface of the photoconductor drum 1 is completed.

As described above, this series of image forming processes is performed on each of the image forming devices 6Y, 6M, 6C, and 6K. That is, the exposure device 7 disposed below the image forming devices 6Y, 6M, 6C, and 6K emits the laser light beams L based on respective image data. More specifically, the exposure device 7 emits the laser light beam L from a light source to be scanned by a polygon mirror in rotation and other multiple optical components to irradiate the surface of the photoconductor drum 1. Then, the toner images of different colors formed on the surfaces of the photoconductor drums 1Y, 1M, 1C, and 1K are transferred onto the surface of the intermediate transfer belt 8 to form a composite color image on the surface thereof.

The intermediate transfer device 15 includes the intermediate transfer belt 8, the primary transfer bias rollers 9Y, 9M, 9C, and 9K, a secondary transfer backup roller 12, multiple tension rollers, and an intermediate cleaning unit (not illustrated). The intermediate transfer belt 8 is stretched taut by the multiple tension rollers and is endlessly rotated by rotation of the secondary transfer backup roller 12 in a direction indicated by arrow A in FIG. 1.

The primary transfer bias rollers 9Y, 9M, 9C, and 9K interpose the intermediate transfer belt 8 with the photoconductor drums 1Y, 1M, 1C, and 1K, respectively, to form primary transfer nip areas. A transfer bias voltage that has a polarity opposite to a toner polarity is applied to the primary transfer bias rollers 9Y, 9M, 9C, and 9K.

The intermediate transfer belt 8 rotates in the direction A and passes the primary transfer nip areas of the primary transfer bias rollers 9Y, 9M, 9C, and 9K sequentially. With this primary transfer operation, respective toner images formed on the surfaces of the photoconductor drums 1Y, 1M, 1C, and 1K are transferred onto the surface of the intermediate transfer belt 8 to form a composite toner image.

The intermediate transfer belt 8 having the composite toner image thereon comes to a position facing a secondary transfer roller 11, where the secondary transfer backup roller 12 and the secondary transfer roller 11 interpose the intermediate transfer belt 8 therebetween to form a secondary transfer nip area. The four-color toner image formed on the intermediate transfer belt 8 is transferred onto a recording medium P such as a transfer paper conveyed to the secondary transfer nip area. At this time, residual toner remains on the surface of the intermediate transfer belt 8.

Thereafter, the surface of the intermediate transfer belt 8 reaches a position facing the non-illustrated intermediate cleaning unit where the residual toner on the surface of the intermediate transfer belt 8 is removed. Thus, a series of transfer processes performed on the surface of the intermediate transfer belt 8 is completed.

The recording medium P conveyed to the secondary transfer nip area is fed from the sheet tray 16 that is disposed at the lower part of the main body 100 of the image forming apparatus 500 via a sheet feed roller 17 and a pair of registration rollers 18 in a counterclockwise that is a direction indicated by arrow B in FIG. 1. Specifically, the sheet tray 16 accommodates a stack of recording media including the recording medium P. As the sheet feed roller 17 rotates in a counterclockwise direction in FIG. 1, the recording medium P that is an uppermost sheet of the stack in the sheet tray 16 is fed and conveyed toward the pair of registration rollers 18 in the direction B.

The recording medium P conveyed to the pair of registration rollers 18 is temporarily stopped at a roller nip area of the pair of registration rollers 18 as the pair of registration rollers 18 stops. For synchronizing with movement of the color toner image formed on the surface of the intermediate transfer belt 8, the pair of registration rollers 18 is rotated to convey the recording medium P toward the secondary transfer nip area. By so doing, a desired color image is formed on the recording medium P. The recording medium P on which the color toner image is transferred in the secondary transfer nip area then travels to a fixing unit 20 where the color toner image formed on the recording medium P is fixed to the recording medium P by application of heat and pressure by means of a transfer belt and a pressure roller.

Thereafter, the recording medium P passes between a pair of sheet discharging rollers 19 and is then discharged outside the main body 100 of the image forming apparatus 500. The recording medium P discharged by the pair of sheet discharging rollers 19 is sequentially stacked as an output image on a stacker 30.

Thus, a series of image forming processes performed in the image forming apparatus is completed.

Next, a description is given of detailed configuration and functions of the developing device 5 of the image forming device 6, with reference to FIG. 2.

As illustrated in FIG. 2, the developing unit 5 includes a development roller 21 disposed facing the photoconductor drum 1, a doctor blade 22 disposed facing the development roller 21, developer containers 23 and 24, and two conveyance screws 25 separately disposed in the developer containers 23 and 24. The developing unit 5 further includes a toner concentration detection sensor 26 to detect toner concentration in the developer.

The development roller 21 includes a magnet roller disposed inside the development roller 21 and a sleeve that rotates around the magnet roller.

The developer containers 23 and 24 accommodate two-component developer G including toner and carriers.

The developer container 24 communicates with a toner transport path 161 via an opening formed on an upper part thereof.

The developing unit 5 having the above-described configuration operates as follows.

The sleeve of the development roller 21 rotates around the magnet roller in a direction indicated by arrow C in FIG. 2. The two-component developer G is held on the surface of the development roller 2 due to a magnetic field generated by the magnet roller and moves on the surface of the development roller 2 with rotation of the sleeve. The two-component developer G in the developing unit 5 is adjusted to have a certain percentage of toner (i.e., toner concentration) within a predetermined range. Specifically, according to an amount of toner consumption in the developing unit 5, the toner accommodated in the toner container 38 is supplied from the toner supply device 160 to the developer container 24 via the toner transport path 161.

Thereafter, the toner supplied to the developer container 24 is mixed and agitated by the two conveyance screws 25 together with the developer G and circulates in the developer containers 23Y and 24Y in a direction perpendicular to the drawing of FIG. 2. Then, the toner in the developer G attracts to the carriers due to frictional charging with the carriers, thereby being held on the surface of the development roller 21 together with the carriers due to a magnetic force formed on the development roller 21.

The developer G held on the development roller 21 is conveyed in the direction C to reach the doctor blade 22, by which the developer G held on the development roller 21 is regulated to an optimized amount and is then conveyed to a development area facing the photoconductor drum 1. There, the toner is attracted to the electrostatic latent image formed on the surface of the photoconductor drum 1 due to an electric field generated in the development area. Thereafter, as the sleeve rotates, residual developer G remaining on the surface of the development roller 21 reaches an upper part of the developer containers 23 to be removed from the development roller 21.

Next, a description is given of details of the toner supply devices 160Y, 160M, 160C, and 160K and the toner containers 38Y, 38M, 38C, and 38K.

In this embodiment, elements or components of the toner supply devices 160Y, 160M, 160C, and 160K are similar in structure and functions identical to each other except colors of toners, and therefore the configuration of the toner supply devices 160Y, 160M, 160C, and 160K is described without symbols. Further, elements or components of the toner containers 38Y, 38M, 38C, and 38K are also similar in structure and functions identical to each other except colors of toners, and therefore the configuration of the toner containers 38Y, 38M, 38C, and 38K is described without symbols.

Figure 3:
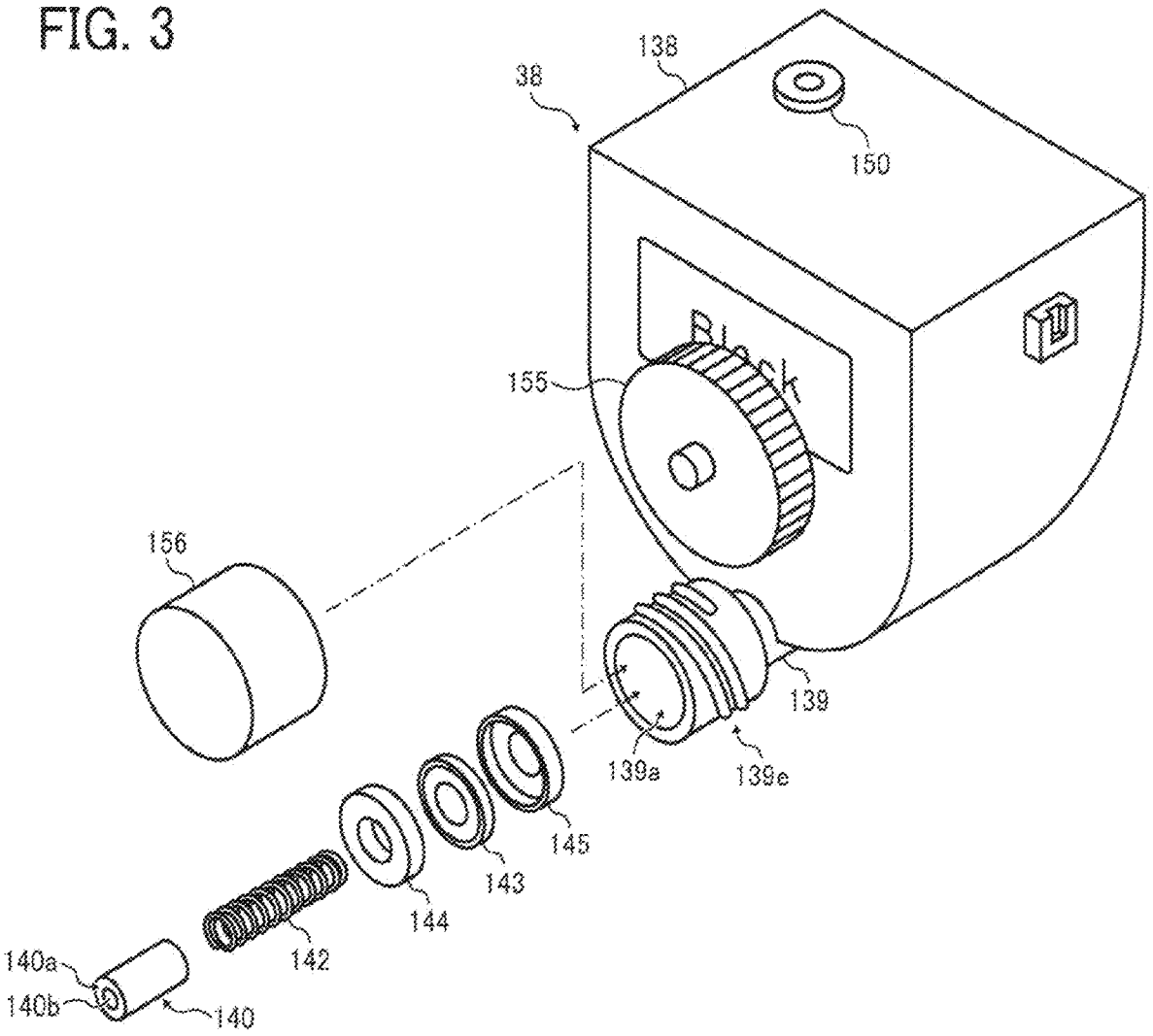
FIG. 3 is an exploded perspective view illustrating an example of a toner container according to an embodiment of the present invention.
Figure 4:
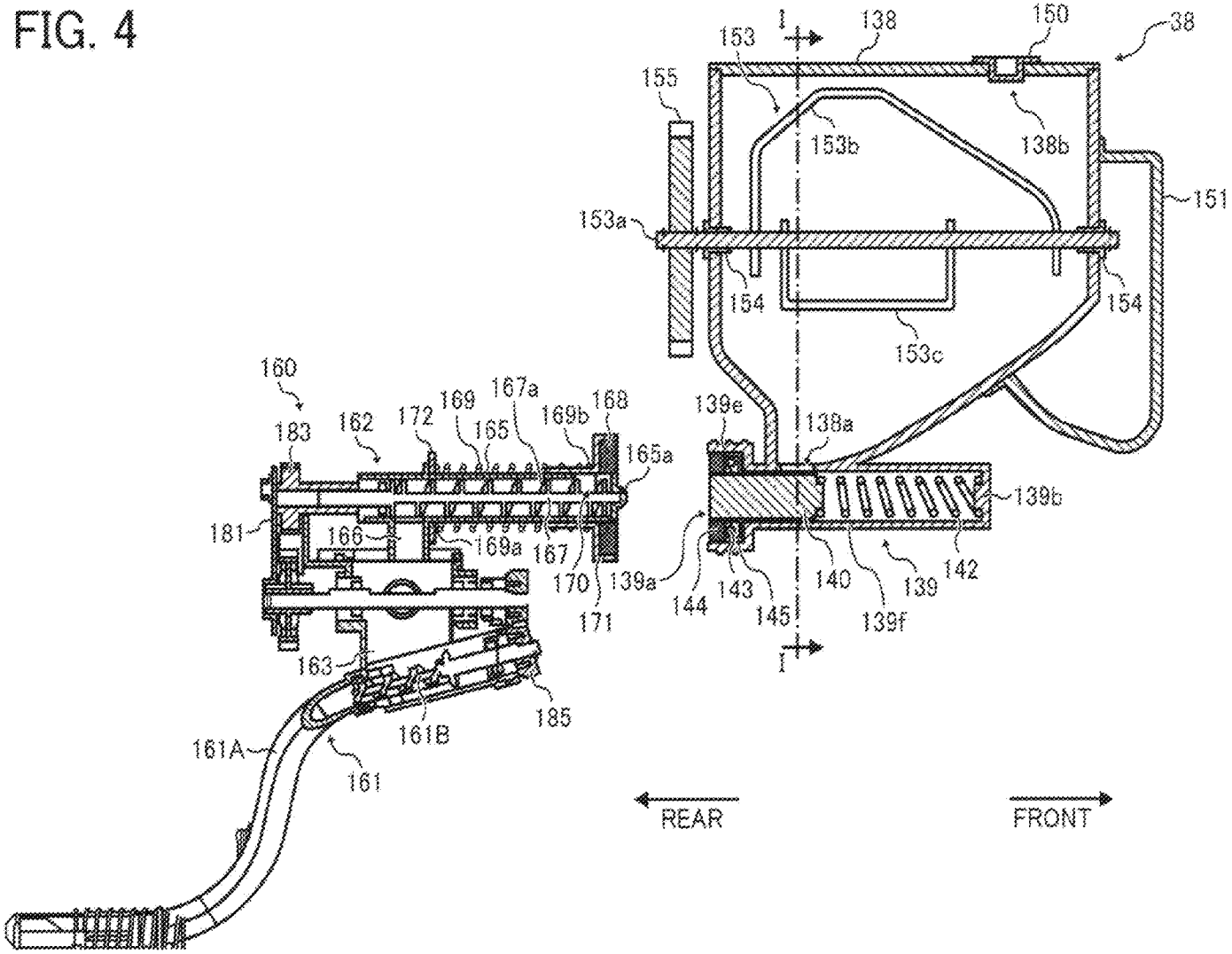
FIG. 4 is a partial cross-sectional view illustrating an example of configuration of the toner container of FIG. 1 and a toner supply device.
Figure 5:
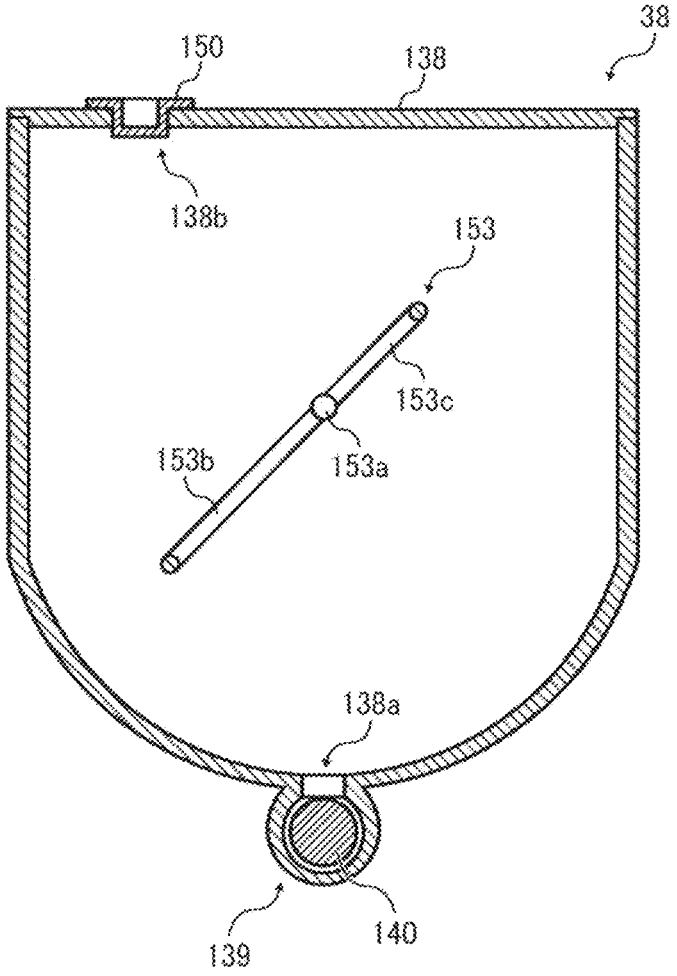
FIG. 5 is a cross-sectional view illustrating the toner container of FIG. 4, taken along the line I-I of FIG. 4.

FIG. 3 is an exploded perspective view illustrating an example of the toner container 38 according to an embodiment of the present invention. FIG. 4 is a partial cross-sectional view illustrating an example of the configurations of the toner container 38 and the toner supply device 160. FIG. 5 is a cross-sectional view illustrating the toner container 38 of FIG. 4, taken along the line I-I of FIG. 4.

The toner container 38 serving as a powder container as illustrated in FIGS. 3 and 4 includes a container body 138 accommodating toner therein, a nozzle receiver 139 serving as a powder receiver disposed at a lower part of the container body 138, and a shutter 140 serving as an opening-closing member used to open and close the toner container 38.

The container body 138 is a substantially box-type hard case and includes a toner outlet 138*a* formed on a bottom surface thereof and a toner supply inlet 138*b* formed on a top surface thereof. The container body 138 communicates with the nozzle receiver 139 via the toner outlet 138*a*. A part of the bottom surface of the container body 138, facing the nozzle receiver 139, has a curved portion with a gentle slope formed for guiding the toner in the container body 138 toward the toner outlet 138*a* by the force of gravity. The toner supply inlet 138*b* is an opening through which toner is supplied to the container body 138. A cap 150 is provided on top thereof to close the toner supply inlet 138*b*. A handle 151 is mounted on a surface at a front side of the container body 138 for removing or installing the toner container 38 from or to the main body 100 of the image forming apparatus 500. The front side in this case is an upper right hand side of FIG. 3 and a right hand side of FIG. 4.

The container body 138 further includes an agitator unit 153 therein. The agitator unit 153 serves as a powder agitator to mix and agitate toner contained in the container body 138, and includes a rotation shaft 153*a* and two agitator arms different in size. The rotation shaft 153*a* functioning as a rotary member is rotatably attached to respective shaft bearings 154 disposed on both surfaces of the front side and a rear side, which are opposed to each other, of the container body 138. The rear side in this case is a lower left hand side of FIG. 3 and a left hand side of FIG. 4. The two agitator arms are a large agitator arm 153*b* and a small agitator arm 153*c*, each functioning as an agitating member, and are attached to the rotation shaft 153*a*. At end portion of the rotation shaft 153*a* that exposes from the container body 138, a driving gear 155 that serves as a drive transmission member to receive a rotation driving force from a rotation driving unit that includes non-illustrated motors and gears is attached.

The nozzle receiver 139 includes a nozzle receiver opening (insertion section) 139*a* functioning as a tube insertion opening to which a transfer nozzle 162 having a toner inlet 170, which serves as a powder inlet, is inserted. Further, the nozzle receiver 139 includes a nozzle receiver body 139*f* that functions as a container opening-closing member supporter. The nozzle receiver body 139*f* accommodates the shutter 140 and a coil spring 142 serving as a container-side biasing member. The nozzle receiver 139 further includes an opening forming member 139*e* that extends outwardly to form the nozzle receiver opening 139*a*. Further, a screwthread is formed on an outer circumference of the opening forming member 139*e* to fit a cap 156 serving as a detachable sealing member that seals the nozzle receiver opening 139*a* during transportation.

The nozzle receiver 139 is a substantially cylindrical member, and the shutter 140 and the transfer nozzle 162 slide through the inner circumference of the nozzle receiver body 139*f*.

The shutter 140 slides in the nozzle receiver 139 as the transfer nozzle 162 is inserted into the nozzle receiver 139, which opens or closes the toner outlet 138*a* and the nozzle receiver opening 139*a*.

The toner outlet 138*a* of the container body 138 is formed such that at least a part thereof is located within a moving range of the shutter 140.

The nozzle receiver 139 has one end in a longitudinal direction on which the nozzle receiver opening 139*a* is formed and the opposite end on which a rear inner wall 139*b* is formed. The rear inner wall 139*b* forms a closed space to receive the coil spring 142 serving as a container-side biasing member. Further, two types of seal member for preventing toner leakage, which are a first seal member 143 and a second seal member 144, and a seal receiving member 145 are included inside the nozzle receiver opening 139*a*. For the first seal member 143, a G seal that is a seal ring having a generally G-shaped section that includes a body and an elastic seal lip formed integrally with the body, for example. In addition to the G seal, a lip seal having a U-shaped or V-shaped cross section and other seal members having the same function as the G seal may be applied. Further, as an example of the second seal member 144, a ring seal member formed by a sponge member may be used.

The shutter 140 is a tubular or cylindrical member to be inserted into the nozzle receiver 139. The coil spring 142 serving as a biasing member is disposed between the shutter 140 and the rear inner wall 139*b* that is located at the opposite end of the nozzle receiver opening 139*a* in the nozzle receiver 139. The shutter 140 is biased by the coil spring 142 toward a closed position where the toner outlet 138*a* and the nozzle receiver opening 139*a* are closed, as illustrated in FIG. 4. The shutter 140 is configured to slide or move in the nozzle receiver 139 as follows. As the transfer nozzle 162 is inserted into the nozzle receiver 139, the shutter 140 slides from the closing position in FIG. 4 toward the rear inner wall 139*b*. The shutter 140 opens the toner outlet 138*a* and the nozzle receiver opening 139*a* and further moves to an open position at which that the container body 138 and the nozzle receiver opening 139*a* of the nozzle receiver 139 are in communication.

Figure 6:
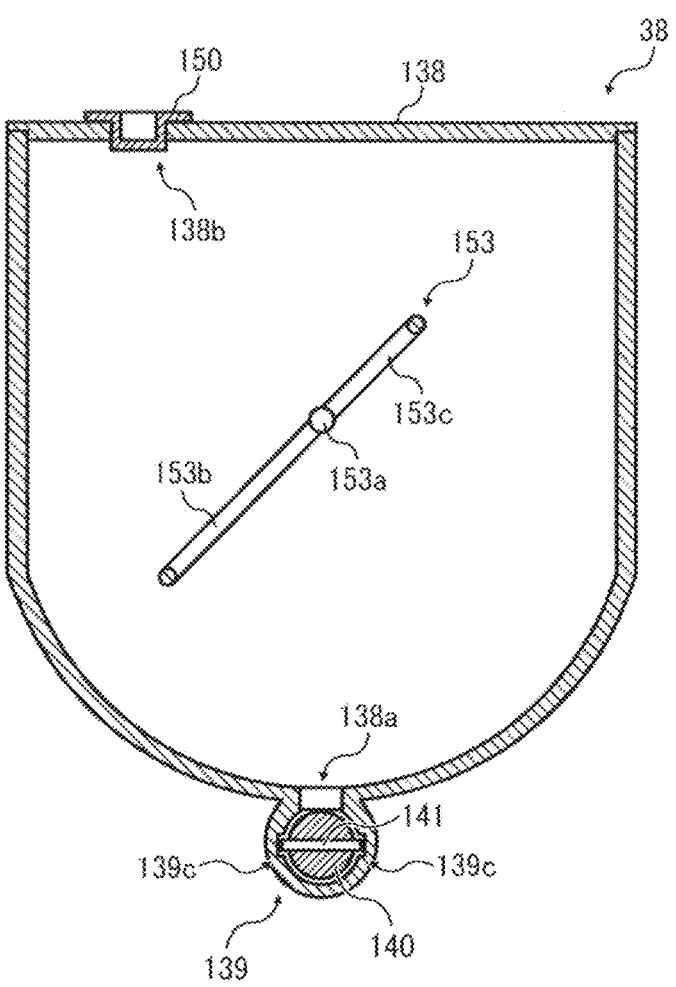
FIG. 6 is a cross-sectional view illustrating a toner container according to a modification of the present invention.

It is to be noted that, as illustrated in FIG. 6, a pin 141 may be inserted to diametrically penetrate the shutter 140 to support the pin 141 in each of slits 139*c* of the nozzle receiver 139. With this configuration, the shutter 140 can be movably supported in the longitudinal direction of the nozzle receiver 139.

Figure 7:
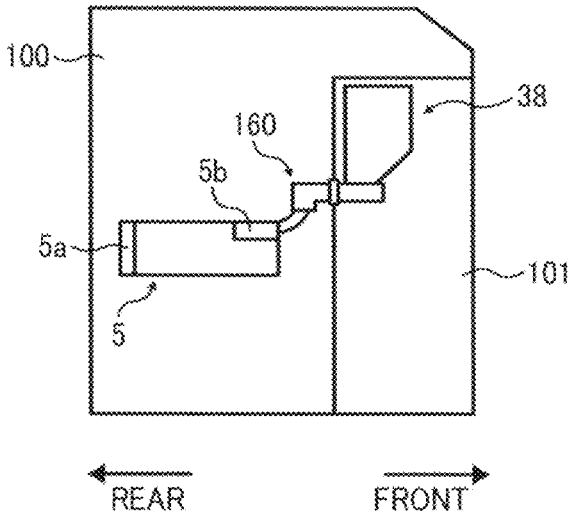
FIG. 7 is a schematic diagram illustrating the toner container attached to the image forming apparatus.

FIG. 7 is a schematic diagram illustrating the toner container 38 is attached to the main body 100 of the image forming apparatus 500.

As illustrated in FIG. 7, the main body 100 of the image forming apparatus 500 includes a front door 101 on a front side thereof and the toner container 38 is slid from the front side to a rear side thereof to be attached to the toner supply device 160 included in the main body 100 so that the handle 151 mounted on the container body 138 is located on the front side thereof. The toner supply device 160 with the toner container 38 attached thereto is connected to a driving portion 5*a* of the developing device 5 and a hopper 5*b* serving as a developer container disposed at an opposed end of the driving device 5.

Figure 8:
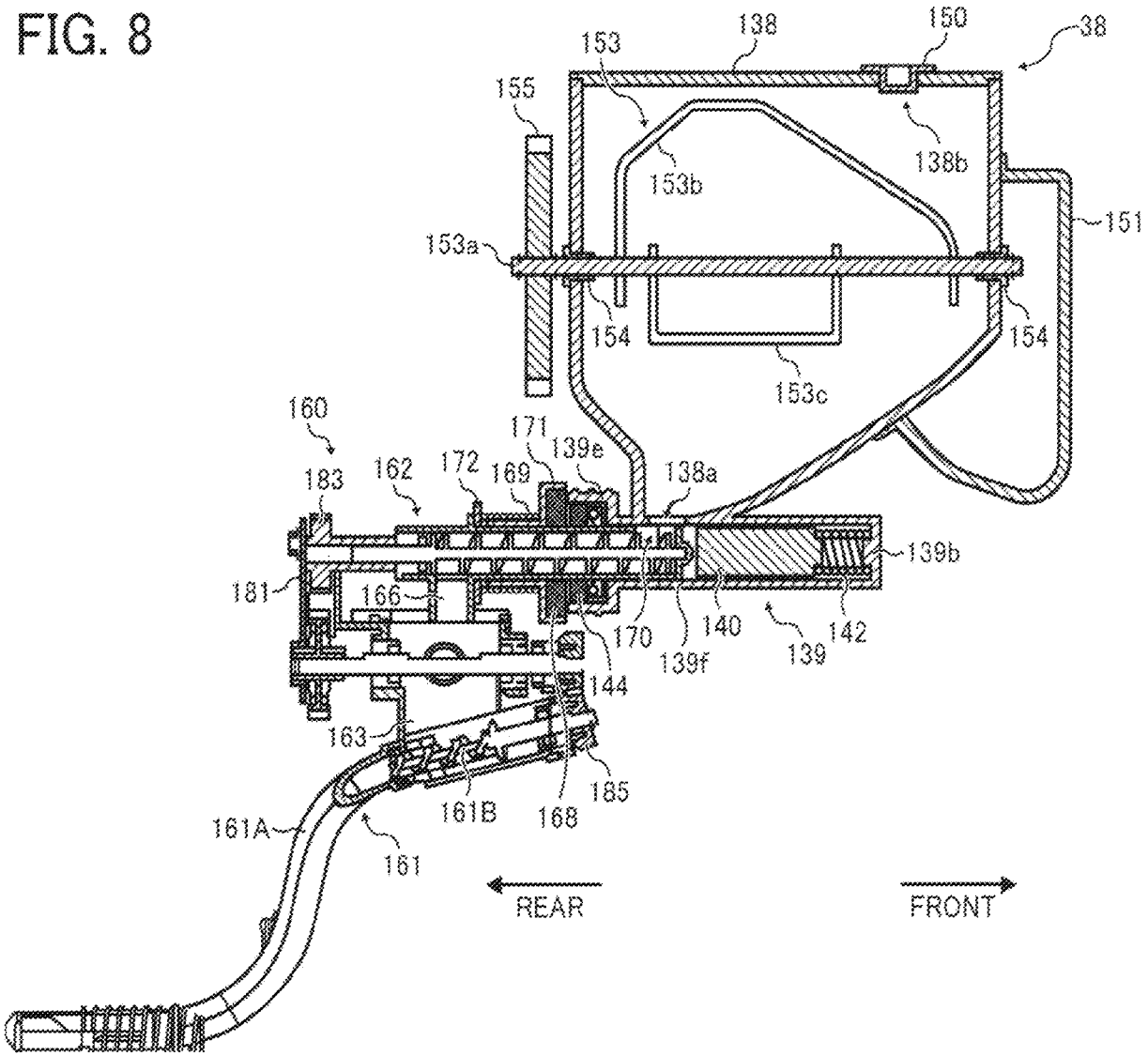
FIG. 8 is a partial cross-sectional view illustrating an example of configuration of the toner supply device with the toner container attached thereto.

Next, a description is given of a detailed configuration of the toner supply device 160, with reference to FIGS. 4 and 8.

FIG. 4 is a partial cross-sectional view illustrating a configuration of the toner container 38 and the toner supply device 160 before the toner container 38 is attached to the toner supply device 160. FIG. 8 is a partial cross-sectional view illustrating a configuration of the toner container 38 and the toner supply device 160 after the toner container 38 is attached to the toner supply device 160.

The toner supply device 160 includes the toner container 38, the transfer nozzle 162 functioning as a transport tube to be inserted into the toner container 38 to receive supplied toner, and the toner transport path 161.

The transport path 161 connects the transfer nozzle 162 and the developing device 5 to transport the supplied toner to the developing device 5.

The transfer nozzle 162 is disposed facing the shutter 140 of the toner container 38 to be incorporated in the toner container holder 31 at the front side of the toner container holder 31, which corresponds to the front side of the main body 100 of the image forming apparatus 500. A sub hopper 163 is provided between the transfer nozzle 162 and the toner transport path 161 to store the supplied toner so that the supplied toner is transported from the transfer nozzle 162 to the toner transport path 161 via the sub hopper 163.

The toner transport path 161 includes a hose 161A and a transport screw 161B that is disposed inside the hose 161A. The transport screw 161B rotates in the hose 161A to transport the toner supplied from the sub hopper 163 to the developing device 5.

As illustrated in FIG. 4, the transfer nozzle 162 includes a nozzle section 165, a connection path 166, a transport screw 167, a seal member 168, and a coil spring 169. The nozzle section 165 is a tubular member to be inserted into the nozzle receiver 139 of the toner container 38. The connection path 166 connects the nozzle section 165 and the sub hopper 163. The transport screw 167 is provided in the nozzle section 165 to transport the toner supplied from the toner container 38 to the connection path 166. The seal member 168 forms a seal surface by contacting the first seal member 143 and the second seal member 144 of the shutter 140. The coil spring 169 serves as a biasing member.

The nozzle section 165 extends in the longitudinal direction of the nozzle receiver 139 of the toner container 38. An outer diameter of the nozzle section 165 is inserted into the nozzle receiver 139 from the nozzle receiver opening 139*a*. The toner inlet 170 is formed on an outer circumferential surface at the leading edge of the nozzle section 165 to guide the toner supplied through the toner outlet 138*a* formed on the container body 138 of the toner container 38 to the transport screw 167. The length of the nozzle section 165 is set so that the toner inlet 170 faces the toner outlet 138*a* when the nozzle section 165 is inserted into the nozzle receiver 139.

The connection path 166 is formed integrally with a base end of the nozzle section 165 that is located on the opposite side of the toner inlet 170 to be in communication with the nozzle section 165.

The toner inlet 170 is arranged to be located on a top surface of the nozzle section 165.

The transport screw 167 includes a screw section 167*a* that is formed between the leading edge of the nozzle section 165 at which a round-shaped projection 165*a* is formed, and the connection path 166, and is rotatably supported by the nozzle section 165.

The seal member 168 is a ring-shaped member formed of a sponge or the like, and is movably supported by a holder 171 in the longitudinal direction on the outer circumferential surface of the nozzle section 165.

The coil spring 169 has one end 169*a* that is latched to the holder 171 that serves as a powder receiver opening-closing member (a contact portion) and is held slidably on the outer circumferential surface of the nozzle section 165 and rotatably about an axis of the nozzle section 165 and the other end 169*b* that is latched to a spring receiving member 172 that is held on the outer circumferential surface of the nozzle section 165. The coil spring 169 urges the seal member 168 toward the first and second seal members 143 and 144, that is, in a direction in which the holder 171 moves away from the spring receiving member 172.

Further, the shutter 140 of the toner container 38 according to this embodiment includes an end surface 140*a* on which a round-shaped recessed portion 140*b* is formed, as illustrated in FIG. 3. A contact surface where the round-shaped projection 165*a* formed at the leading edge of the nozzle section 165 contacts the round-shaped recessed portion 140*b* formed on the end surface 140*a* of the shutter 140 is a sliding contact surface.

The toner inlet 170 is formed to be opposed to the toner outlet 138*a* of container body 138 when the nozzle section 165 is inserted into the container body 138 from the nozzle receiver opening 139*a* of the nozzle receiver 139. Further, the toner inlet 170 is formed on the top surface of the nozzle section 165 and constantly remains the direction. Therefore, when the toner container 38 is attached to the toner container holder 31, the toner in the toner container 38 can be supplied from the toner outlet 138*a* to the toner inlet 170 reliably.

Figure 9A:
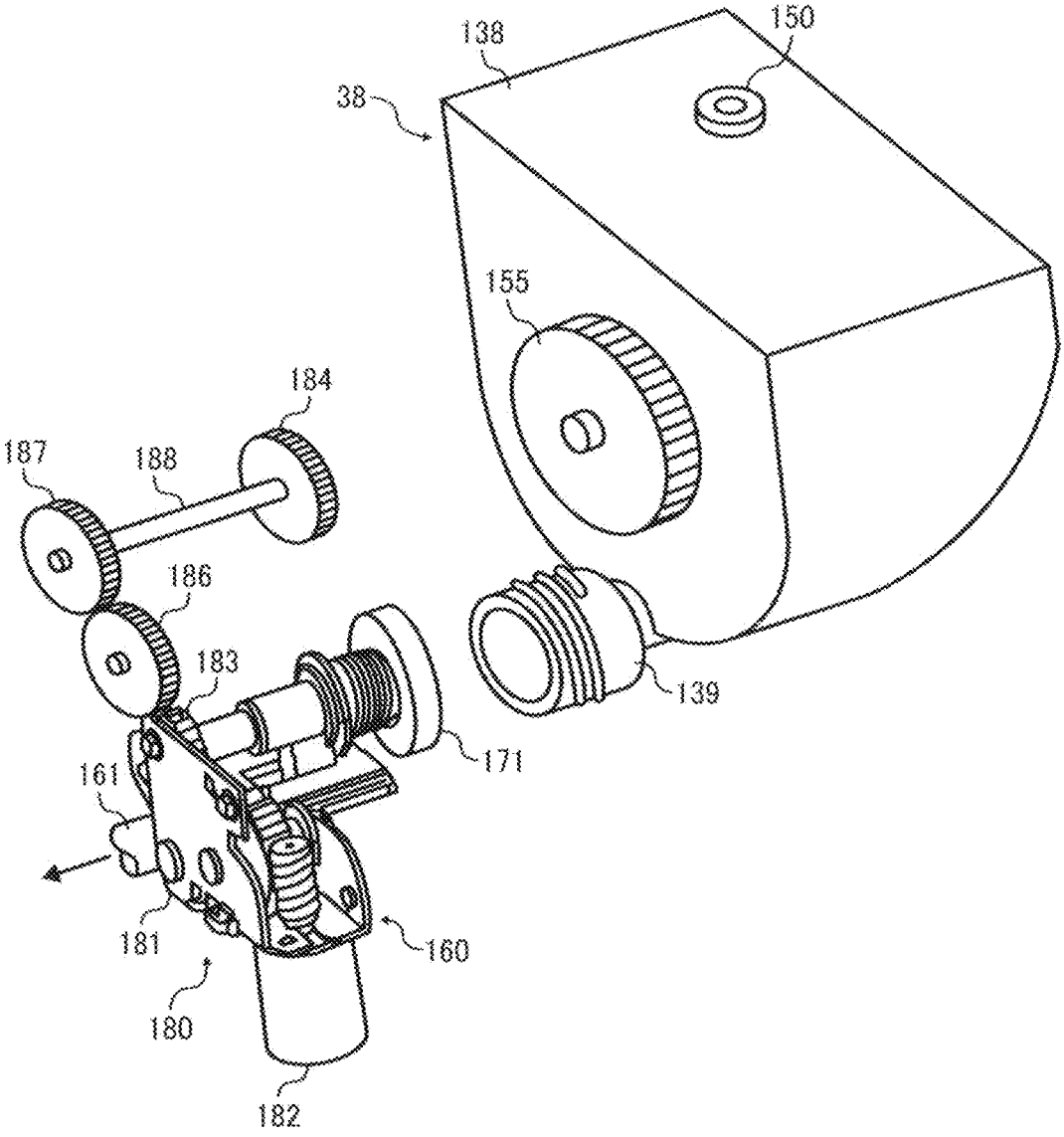
FIG. 9A is a perspective view illustrating an entire configuration of the toner supply device including the toner container.
Figure 9B:
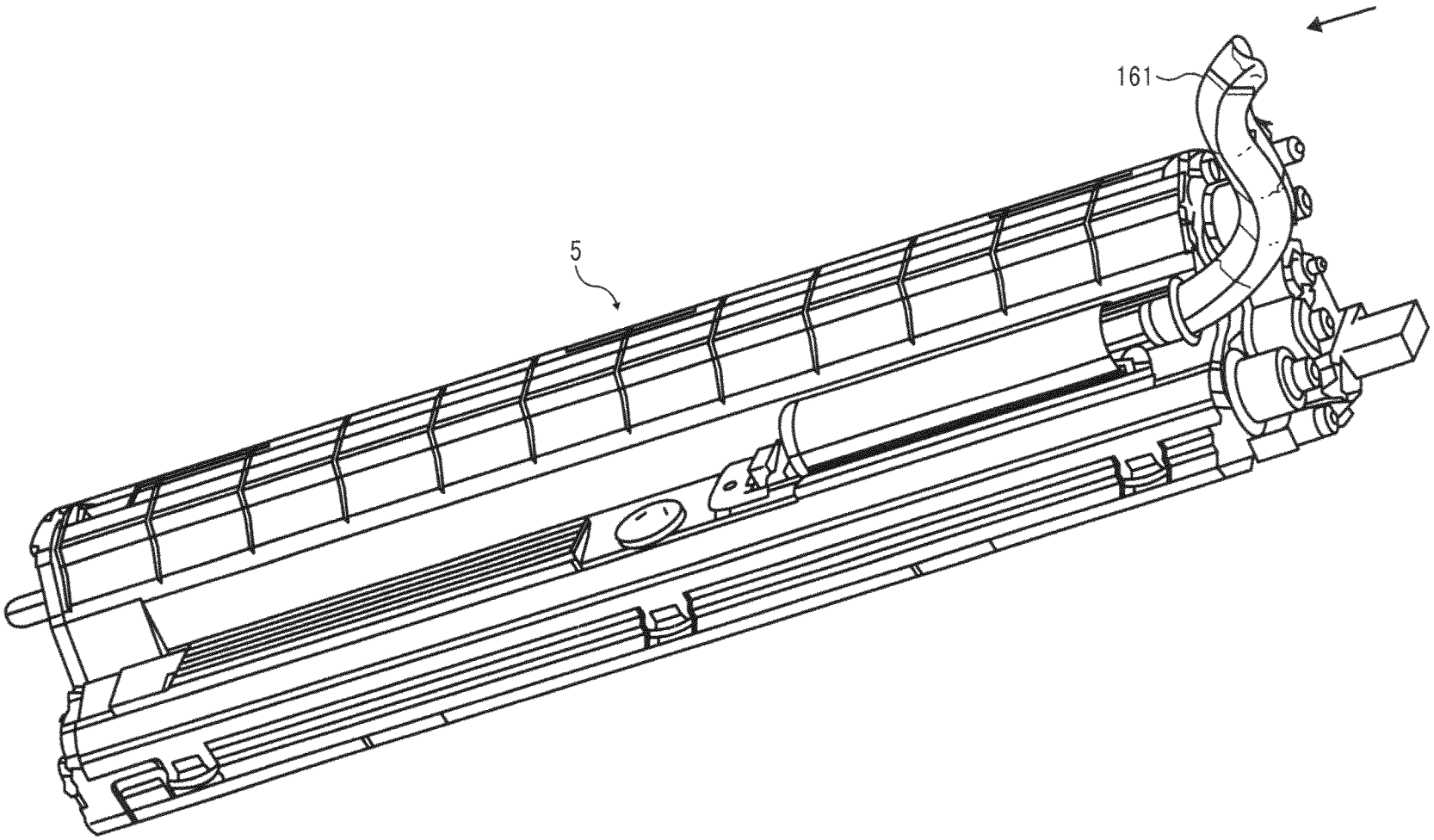
FIG. 9B is a perspective view illustrating a state in which the toner supply device is contacted to a developing device.

Next, a description is given of a configuration of a drive device 180 included in the toner supply device 160, with respect to FIGS. 9A and 9B.

FIG. 9A is a perspective view illustrating an entire configuration of the toner supply device 160 including the toner container 38. FIG. 9B is a perspective view illustrating a state in which the toner supply device 160 is contacted to the developing device 5. As shown, the toner supply device 160 illustrated in FIG. 9A and the developing device 5 illustrated in FIG. 9B are connected via the toner transport path 161. Toner contained in the toner container 38 flows in a direction indicated by arrows in FIGS. 9A and 9B.

As illustrated in FIG. 9A, the drive device 180 includes a frame 181, a drive motor 182 that serves as a drive source fixed to the frame 181, a gear 183 fixed to an end of the transport screw 167, a gear 184 to mesh with the driving gear 155 of the container body 138 when the toner container 38 is mounted to the toner container holder 31 (see FIG. 1), a gear 185 (see FIGS. 4 and 8) fixed to an end of the transport screw 161B shown in FIG. 8, and a gear train meshing with the gears 183 and 185 and transmitting a rotation force of the drive motor 182 to each gear. The rotation force of the gear 183 is transmitted to the driving gear 155 of the container body 138 via gears 186 and 187, a rotary shaft 188, and the gear 184. The drive motor 182 is controlled by a controller (not illustrated) to rotate for a certain period of time when the controller detects a toner supply signal with the toner container 38 installed in the toner container holder 31.

Next, a description is given of operations of the toner supply device 160 with reference to FIGS. 4 and 8.

Before attaching the toner container 38 to the toner container holder 31, e.g., during transportation or storage, the nozzle receiver opening 139*a* and the toner outlet 138*a* of the container body 138 are closed by the shutter 140 biased by the coil spring 142. Specifically, communication between the nozzle receiver opening 139*a* of the nozzle receiver 139 and the toner outlet 138*a* of the container body 138 is shut down, which results in a substantially closed state of the toner container 38. For installing the toner container 38 to the toner container holder 31 in the substantially closed state, while the toner container holder 31 remains horizontal, the toner container 38 is moved toward the toner supply device 160, with the nozzle receiver opening 139*a* first as the leading edge thereof, so that the toner nozzle 162 of the toner supply device 160 is inserted into the toner container 38. As the toner nozzle 162 is further inserted, the leading edge of the nozzle section 165 contacts the end surface 140*a* of the shutter 140.

As the toner container 38 is further moved toward the rear side of the main body 100 of the image forming apparatus 500, the shutter 140 is pressed by the nozzle section 165 against a biasing force of the coil spring 142 and is further pushed into the nozzle receiver 139. Further, along with movement of the toner container 38, the seal member 168 is also pressed by the toner container 38 against a biasing force of the coil spring 169 and is pushed toward the rear side of the main body 100 of the image forming apparatus 500. With these actions, the seal member 168 and the second seal member 144 are pressed against each other, thereby securing sealability of the nozzle receiver opening 139*a*.

After being entirely installed to the toner container holder 31*he* movement of the toner container 38 and held by a supporter (not illustrated), the toner container 38 stops moving and stays in its installation position in the toner container holder 31. The nozzle section 165 causes the shutter 140 to slide further in the nozzle receiver 139 until the toner container 38 reaches the installation position. Then, once the toner container 38 occupies the installation position, the movement of the shutter 140 stops and stays in the closed position as illustrated in FIG. 8.

At this time, the nozzle receiver opening 139*a* is released as well as the toner outlet 138*a*, and therefore the toner inlet 170 faces the toner outlet 138*a* of the container body 138 and becomes in communication with the toner container 38, as illustrated in FIG. 8.

As described above, the toner container 38 includes the nozzle receiver 139, which is disposed below the container body 138 and to which the nozzle section 165 of the transfer nozzle 162 with the toner inlet 170 formed thereon, and the shutter 140, which is supported by the nozzle receiver 139 with the nozzle receiver opening 139*a* openably closable and slides in the nozzle receiver 139 due to insertion of the nozzle section 165 into the nozzle receiver 139 and opens and closes at least the nozzle receiver opening 139*a* and the toner outlet 138*a*. According to this configuration, the nozzle receiver opening 139*a* and the toner outlet 138*a* remain in the closed state until the nozzle section 165 is inserted into the nozzle receiver 139. When the nozzle section 165 is inserted into the nozzle receiver 139 to cause the shutter 140 to slide therein, the nozzle receiver opening 139*a* and the toner outlet 138*a* are released. With this action, toner can be supplied from the toner outlet 138*a* to the toner inlet 170 reliably, thereby preventing toner leakage or scattering in the toner container 38 and discharging the toner outside the toner container 38 reliably.

After the toner container 38 has occupied the installation position, the image forming apparatus 500 has started its operation, and the toner supply signal has been output from the controller, the drive motor 182 illustrated in FIG. 9A rotates. A driving force exerted by the drive motor 182 is transmitted to the transport screw 167 in the nozzle section 165 via the gear 183. Due to this driving force, as the transport screw 167 is rotated by the driving force in a direction to transport the toner to the connection path 166, the driving force is further transmitted to the transport screw 161B provided in the toner transport path 161 via the gear 185 illustrated in FIGS. 4 and 8, by which the transport screw 161B rotates in a direction to transport the toner to the developing device 5.

The toner supplied into the nozzle section 165 is transported by the transport screw 167 toward the connection path 166 and drops therefrom. The toner dropped through the connection path 166 is transported to the toner transport path 161 via the sub hopper 163 illustrated in FIGS. 4 and 8. Then, according to rotation of the transport screw 161B, the toner is transported to the developing device 5 for toner supply.

Now, a description is given of the toner container 38 for transportation and storage according to the present embodiment.

Figure 10:
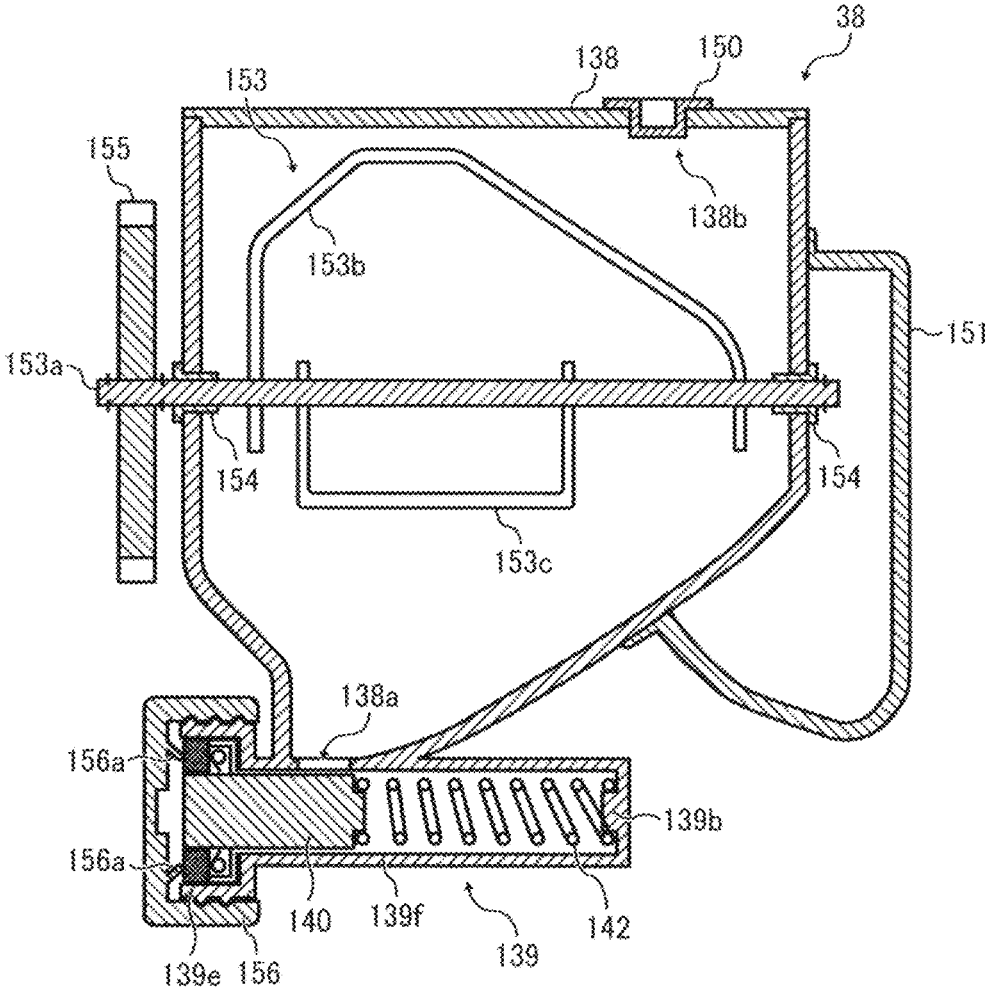
FIG. 10 is a cross-sectional view illustrating the toner container for transportation and storage.
Figure 11:
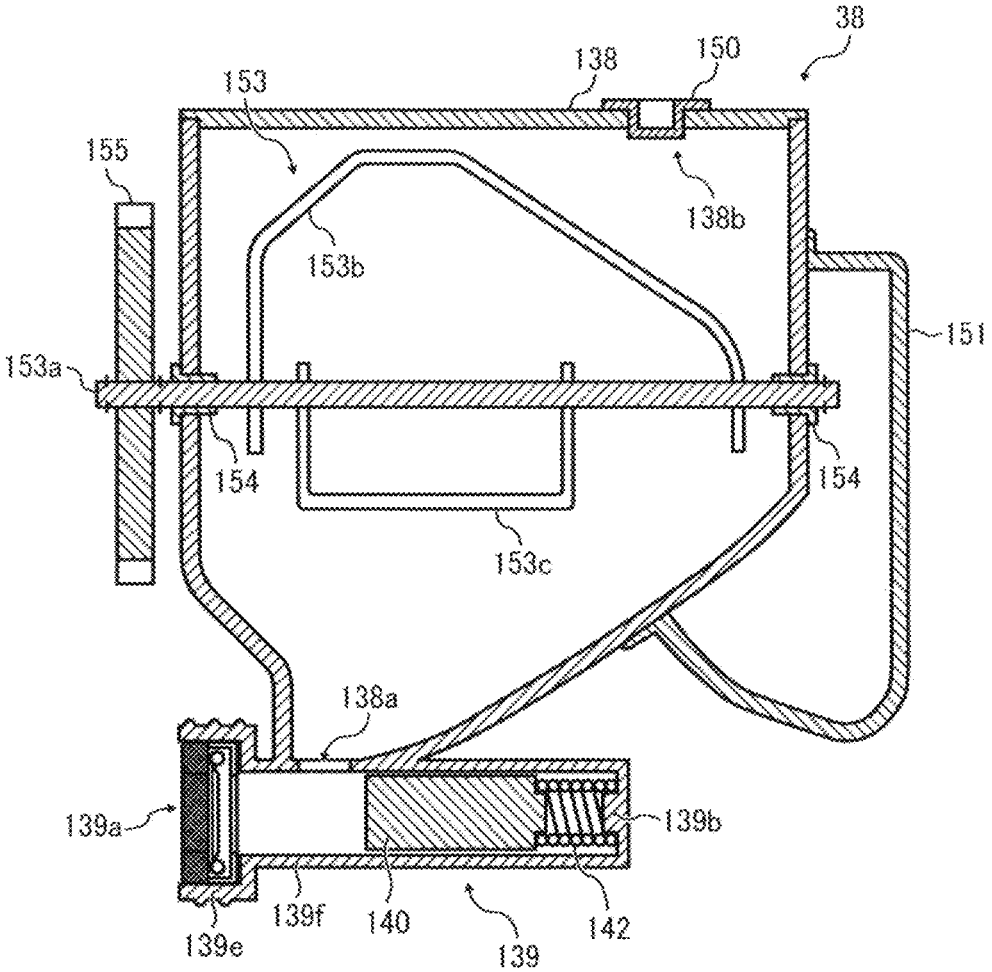
FIG. 11 is a cross-sectional view illustrating the toner container in the open state in which a cap is removed.

FIG. 10 is a cross-sectional view illustrating the toner container 38 in the closed state in which the cap 156 is attached during transportation and storage, and FIG. 11 is a cross-sectional view illustrating the toner container 38 in the open state in which the cap 156 is removed.

As illustrated in FIG. 10, for transportation or storage of the toner container 38, the cap 156 serving as a detachable sealing member to seal the nozzle receiver opening 139*a* is attached to the opening forming member 139*e* arranged at the one end of the nozzle receiver 139. At this time, the leading edge of a ring-shaped projection (lip) 156*b* that is formed on an inner surface of the cap 156 contacts one side of the ring-shaped second seal member 144 formed of a sponge, thereby reliably preventing toner leakage from the toner container 38.

By contrast, when the toner container 38 is open, the cap 156 is removed as illustrated in FIG. 11 and the nozzle section 165 is inserted into the nozzle receiver opening 139*a* of the nozzle receiver 139, by which the shutter 140 is pressed in the nozzle receiver 139 against the biasing force of the coil spring 142. With this action, the toner can be supplied from the container body 138 to the toner supply device 160 via the toner outlet 138*a* and the nozzle receiver opening 139*a*.

Figure 12:
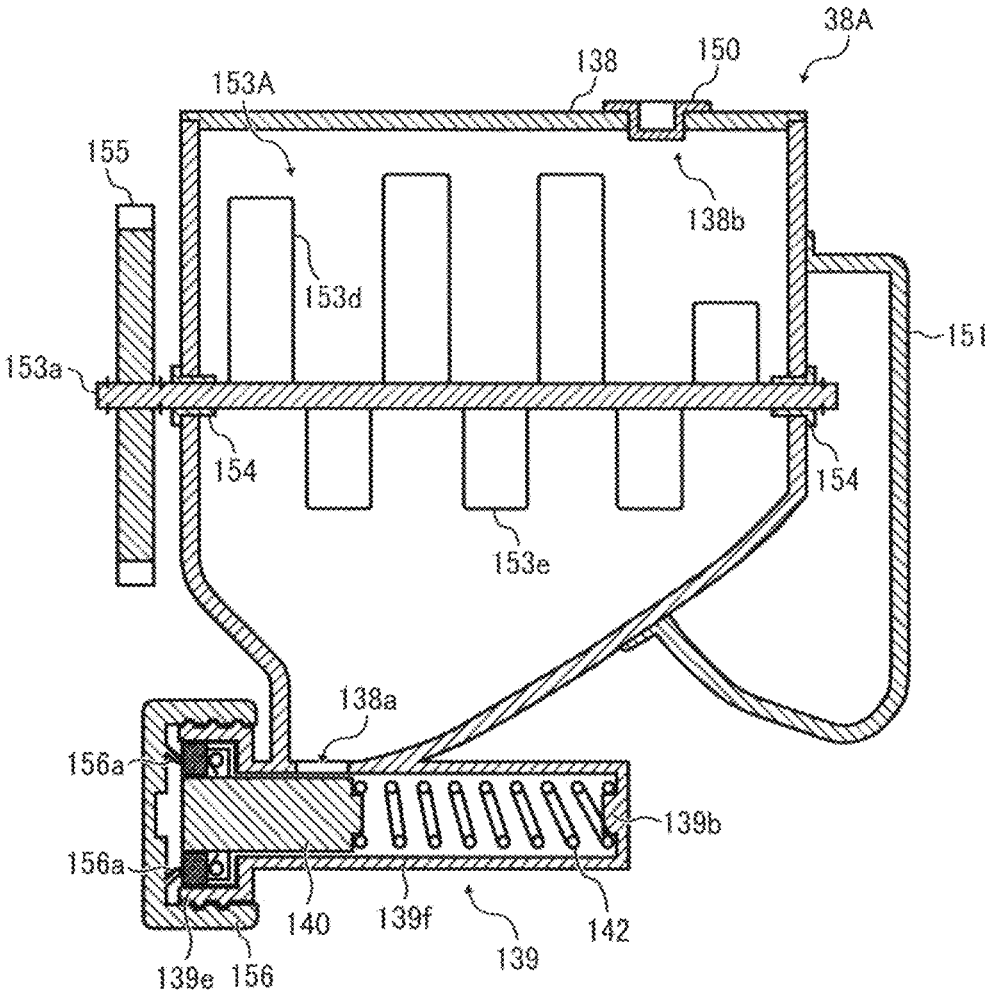
FIG. 12 is a cross-sectional view illustrating the toner container for transportation and storage according to another embodiment of the present invention.
Figure 13:
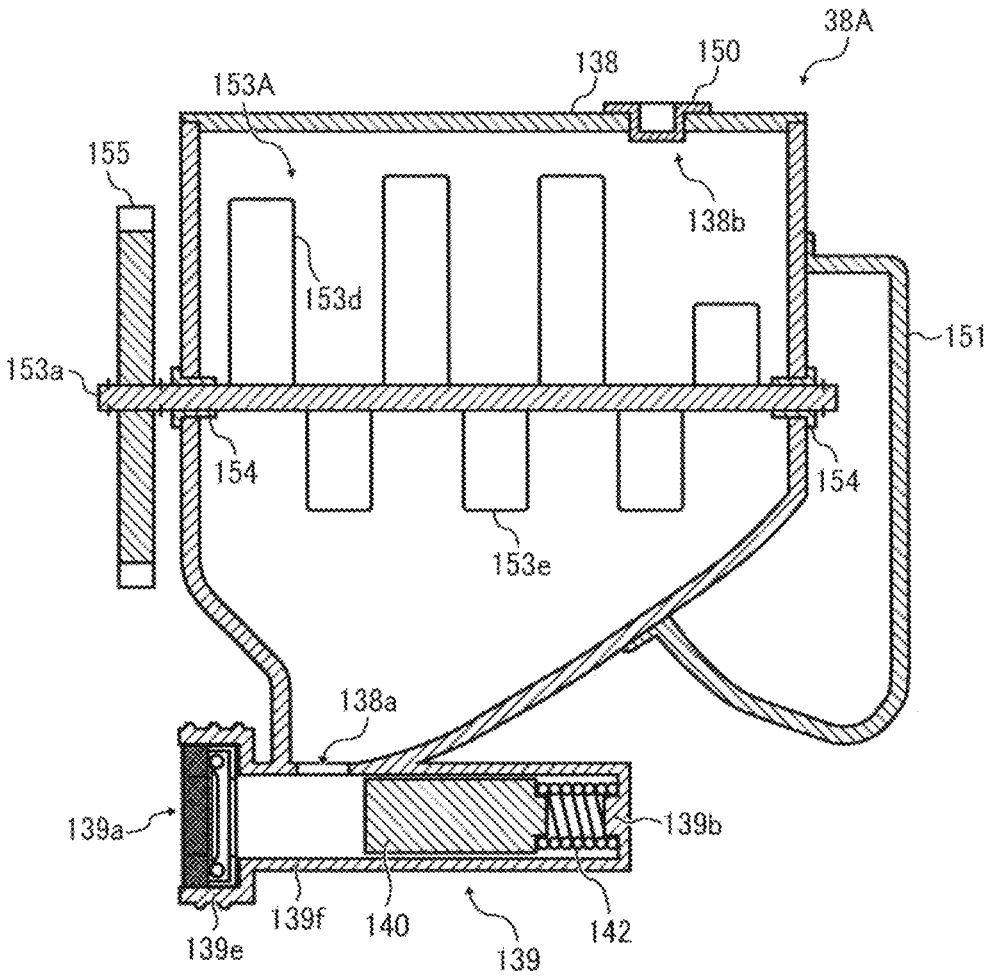
FIG. 13 is a cross-sectional view illustrating the toner container in the open state in which the cap is removed.

Now, a description is given of a toner container 38A for transportation and storage according to another embodiment of the present invention with reference to FIGS. 12 and 13.

FIG. 12 is a cross-sectional view illustrating the toner container 38A in the closed state in which the cap 156 is attached during transportation and storage, and FIG. 13 is a cross-sectional view illustrating the toner container 38A in the open state in which the cap 156 is removed. In this embodiment, components already described with reference to FIGS. 10 and 11 are denoted by the same reference numerals, and thus detailed description thereof will be hereinafter omitted.

While the toner container 38 illustrated in FIGS. 10 and 11 includes the agitator unit 153 that includes two linear agitator arms (i.e., the large agitator arm 153*b* and the small agitator arm 153*c*) in the container body 138, the toner container 38A illustrated in FIGS. 12 and 13 includes an agitator unit 153A that includes two planar agitator arms (i.e., a large agitator mylar 153*d* and the small agitator mylar 153*e*) in the container body 138.

Figure 14:
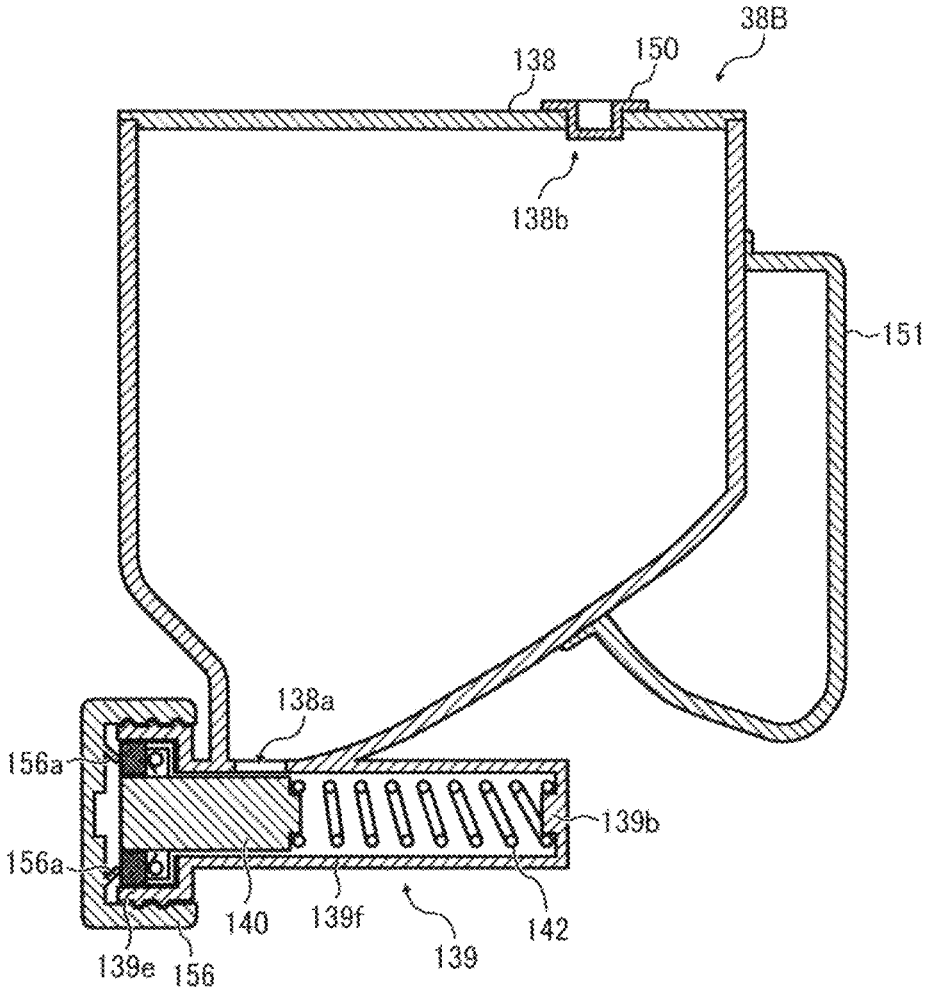
FIG. 14 is a cross-sectional view illustrating the toner container for transportation and storage according to yet another embodiment of the present invention.
Figure 15:
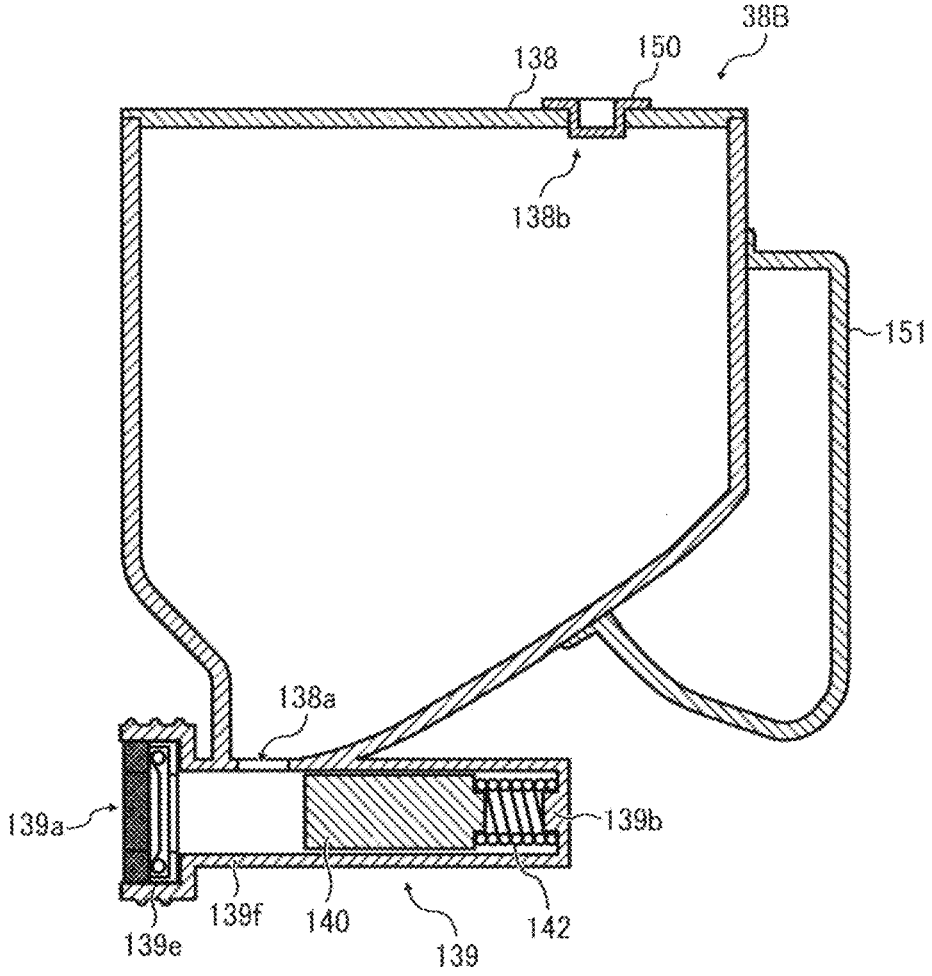
FIG. 15 is a cross-sectional view illustrating the toner container in the open state in which the cap is removed.

Now, a description is given of a toner container 38B for transportation and storage according to yet another embodiment of the present invention with reference to FIGS. 14 and 15.

FIG. 14 is a cross-sectional view illustrating the toner container 38B in the closed state in which the cap 156 is attached during transportation and storage, and FIG. 15 is a cross-sectional view illustrating the toner container 38B in the open state in which the cap 156 is removed. In this embodiment, components already described with reference to FIGS. 10 and 11 are denoted by the same reference numerals, and thus detailed description thereof will be hereinafter omitted.

While the toner container 38 illustrated in FIGS. 10 and 11 includes the agitator unit 153 in the container body 138, the toner container 38B illustrated in FIGS. 14 and 15 does not include any agitator.

Figure 16:
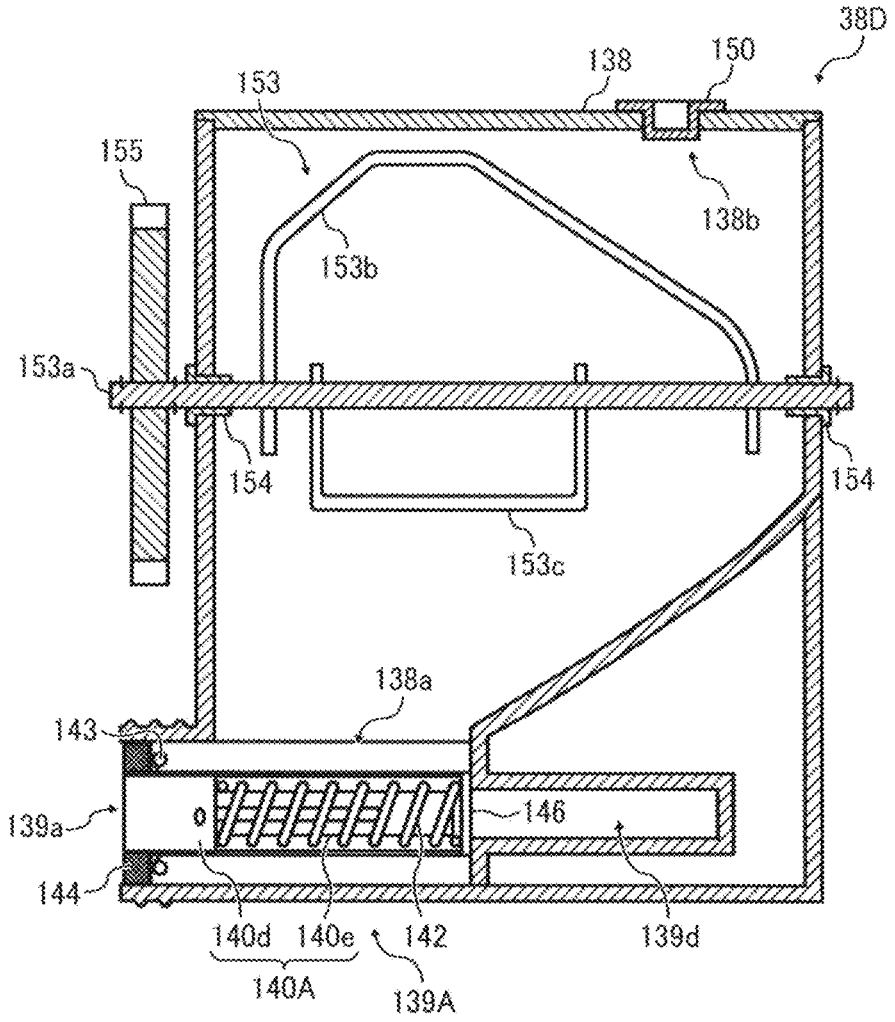
FIG. 16 is a cross-sectional view illustrating a toner container according to yet another embodiment of the present invention.

Now, a description is given of a toner container 38D according to yet another embodiment of the present invention with reference to FIG. 16.

FIG. 16 is a cross-sectional view illustrating the toner container 38D. In this embodiment, components already described with reference to FIG. 4 are denoted by the same reference numerals, and thus detailed description thereof will be hereinafter omitted.

The toner container 38D includes a nozzle receiver 139A including a shutter 140A and components around the shutter 140A, which are different from the above-described embodiments. The shutter 140A includes a shutter body 140*d*, and a cylindrical guide arm 140*e* that is disposed opposite to the nozzle receiver opening 139*a* of the shutter body 140*d* and is inserted into the coil spring 142. When the toner container 38 is in an open state, by pushing the nozzle section 165 into the nozzle receiver opening 139*a* of the nozzle receiver 139, the shutter body 140*d* is pressed against the biasing force of the coil spring 142 into the nozzle receiver 139. By so doing, the toner can be supplied from the container body 138 to the toner supply device 160 via the toner outlet 138*a* and the nozzle receiver opening 139*a*. At this time, the guide arm 140*e* of the shutter 140A is inserted into a run-off 139*d* that is formed by a cylindrical space on the rear side of the nozzle receiver 139A.

Figure 17:
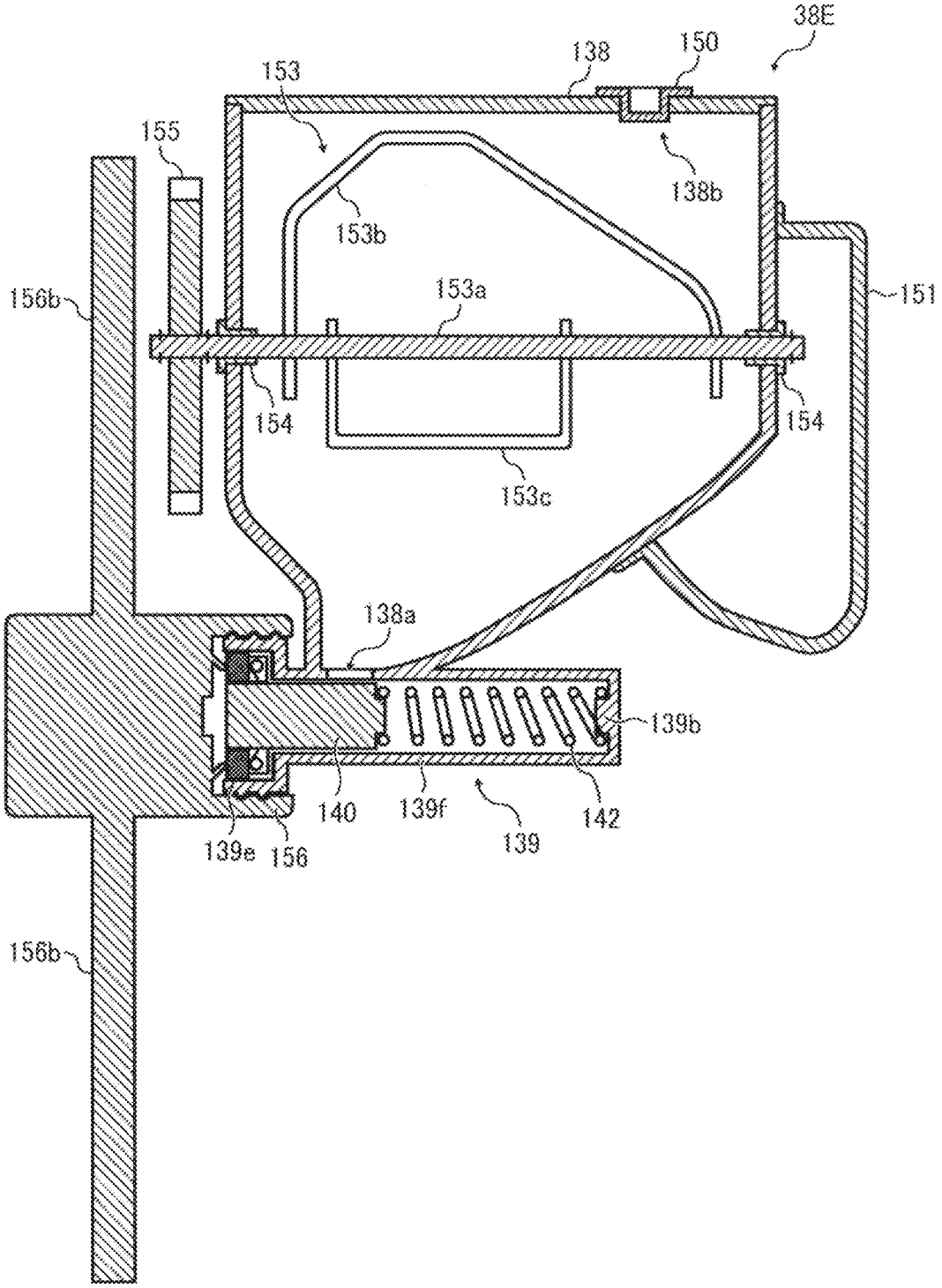
FIG. 17 is a cross-sectional view illustrating the toner container of FIG. 16 for transportation and storage.

Now, a description is given of a toner container 38E according to yet another embodiment of the present invention with reference to FIG. 17.

FIG. 17 is a cross-sectional view illustrating the toner container 38E. In this embodiment, components already described with reference to FIG. 4 are denoted by the same reference numerals, and thus detailed description thereof will be hereinafter omitted.

The toner container 38E includes a flange 156*b* that is a disk shaped member mounted on the cap 156 attached to the opening forming member 139*e* of the nozzle receiver 139. In the present embodiment, the cap 156 with the flange 156*b* protects the driving gear 155 and other components in the toner container 38E during transportation and storage of the toner container 38E.

Now, a description is given of modifications of the agitator unit 153 that can be employed in the configurations according to the above-described embodiments.

Figure 18A:
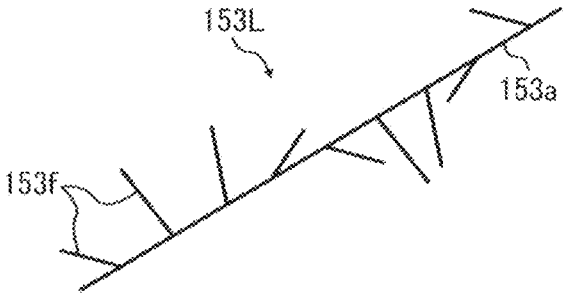
FIGS. 18A and 18B are perspective views of agitators according to respective modifications.
Figure 18B:
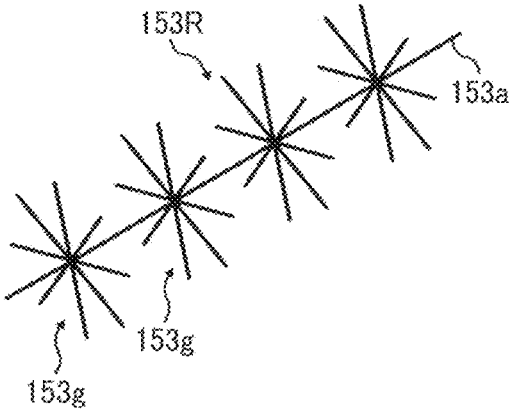

FIGS. 18A and 18B are perspective views of modified agitator units 153L and 153R, respectively, which can be provided in the container body 138 of the toner containers 38, 38A, 38B, 38D, and 38E. As illustrated in FIG. 18A, the agitator unit 153L includes multiple bar-shaped or linear agitator arms 153*f* are provided at predetermined intervals along an axial direction of the rotation shaft 153*a*, with the setting angles of the agitator arms 153*f* changed sequentially. Further as illustrated in FIG. 18B, the agitator unit 153R includes multiple radial agitator arms 153*g* are provided at predetermined intervals along the axial direction of the rotation shaft 153*a*.

Figure 19:
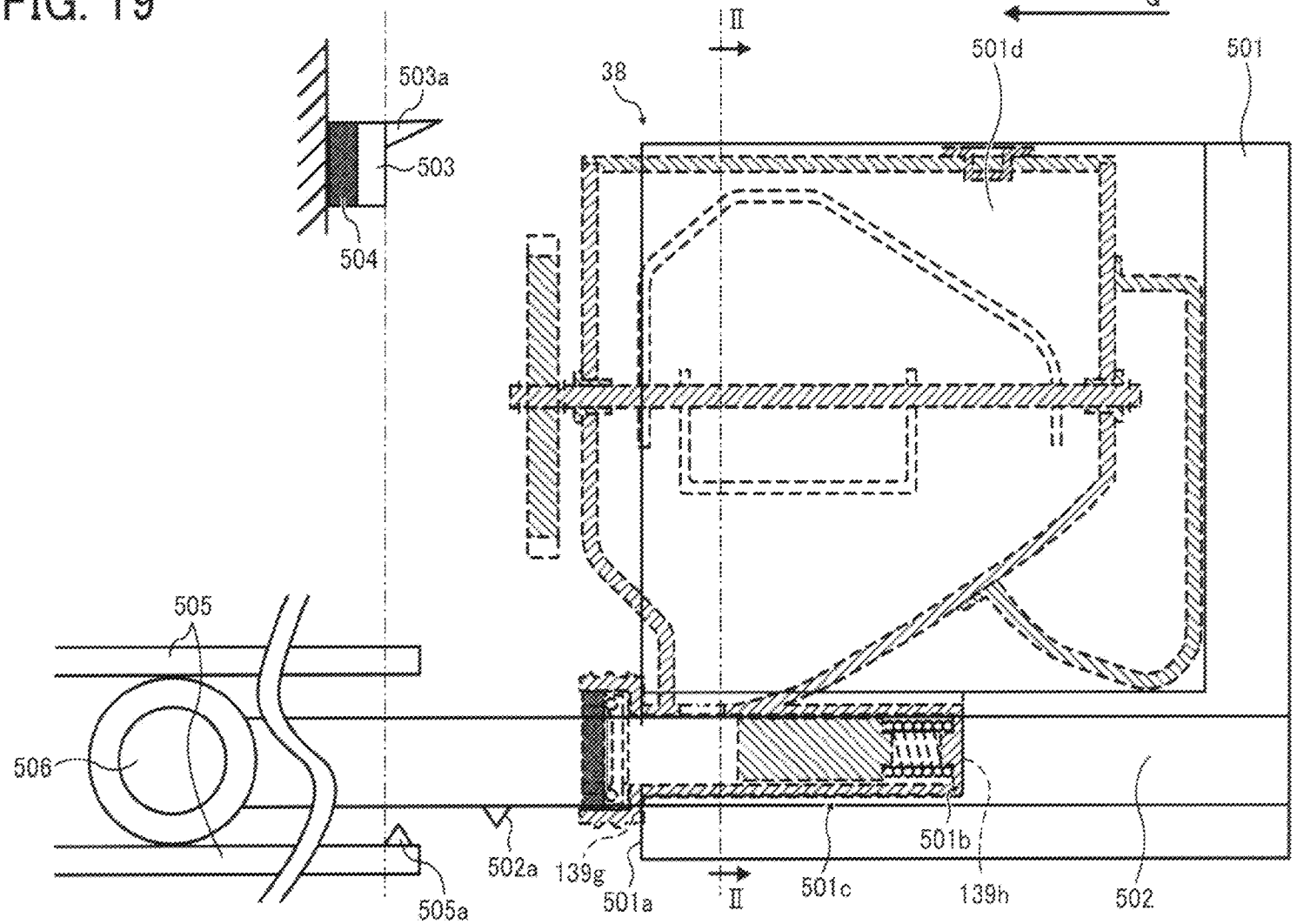
FIG. 19 is a side view illustrating a container tray that includes a toner container.
Figure 20:
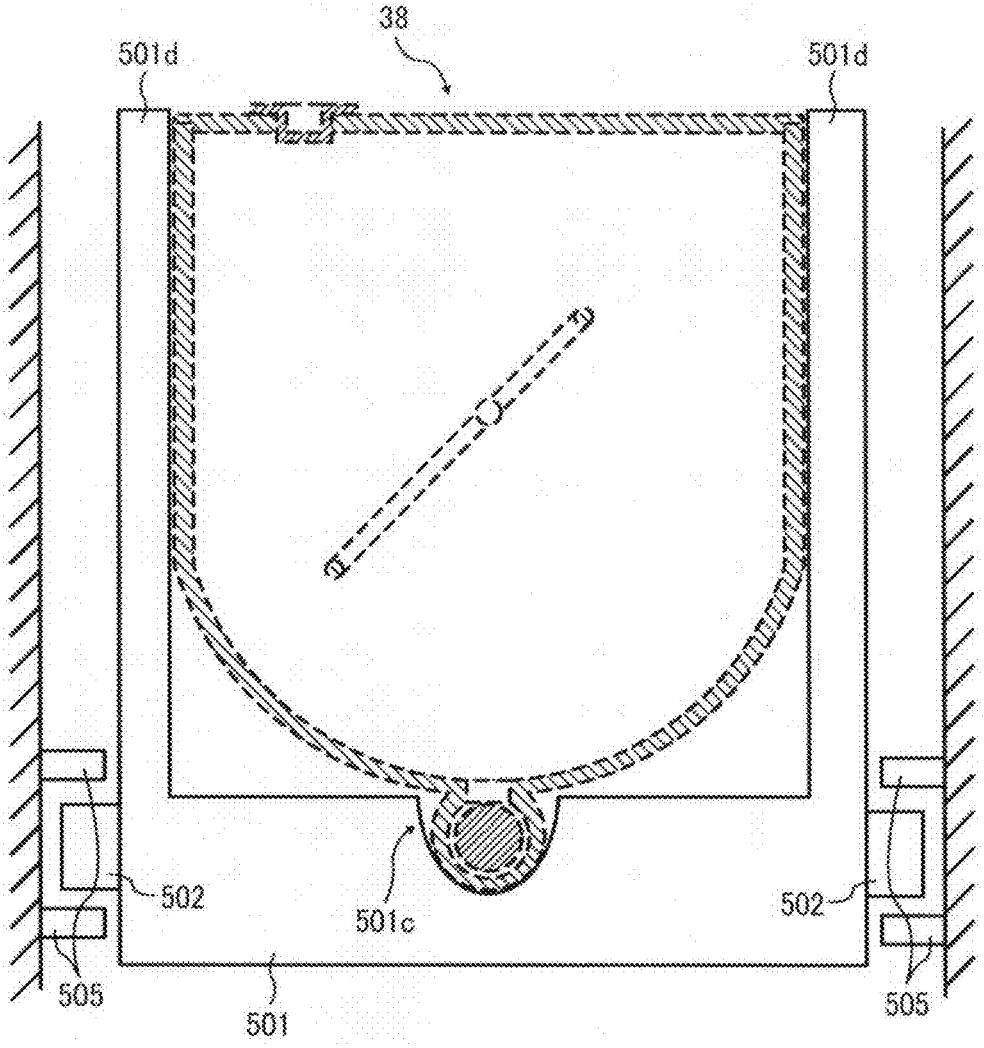
FIG. 20 is a cross-sectional view illustrating the container tray and the toner container of FIG. 19, taken along the line II-II.
Figure 21:
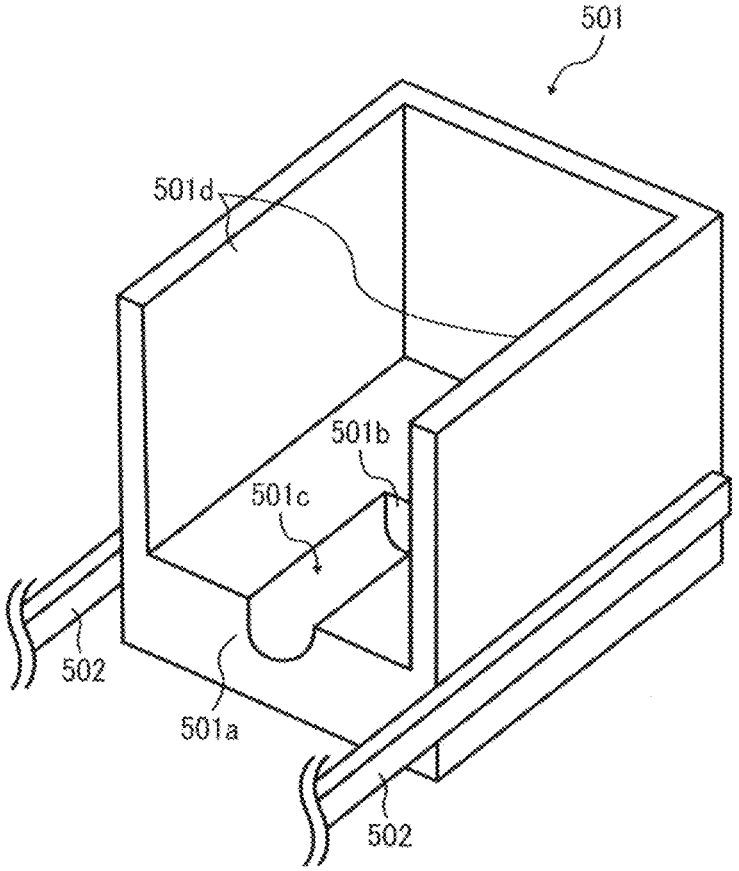
FIG. 21 is a perspective diagram illustrating the container tray.

Next, a detailed description is given of processes of attachment of the toner container 38, 38A, 38B, 38D, and 38E to the image forming apparatus 500 with reference to FIGS. 19 through 21. Hereinafter, the toner containers 38, 38A, 38B, 38D, and 38E may be described simply as the toner container 38.

FIG. 19 is a side view illustrating a container tray 501 functioning as a container receiver to accommodate the toner container 38 therein, FIG. 20 is a cross-sectional view illustrating the container tray 501 and the toner container 38 of FIG. 19, taken along the line II-II, and FIG. 21 is a perspective view illustrating the container tray 501.

The container tray 501 is included in the toner container holder 31 (see FIG. 1). The container tray 501 illustrated in FIG. 19 has a configuration to receive one toner container 38. However, the configuration is not limited thereto. For example, the container tray 501 may be configured to receive the toner containers 38Y, 38M, 38C, and 38K altogether.

As illustrated in FIG. 19, the container tray 501 includes a first contact surface 501*a*, a second contact surface 501*b*, a recessed portion 501*c*, tray side surfaces 501*d*, side rails 502 fixed to an inner wall of each of the tray side surfaces 501*d*, and bearings 506. Each of the bearings 506 functioning as a rotary member is attached at the leading edge of the respective side rails 502. The bearings 506 of the side rails 502 guide the container tray 501 to slide along respective guide rails 505, each of which mounted on an inner wall of the image forming apparatus 500, in a direction Q indicated by arrow in FIG. 19 or in an opposite direction to the direction Q.

The first contact surface 501*a* is disposed such that a step 139*g* formed on the leading edge of the nozzle receiver 139 of the toner container 38. The second contact surface 501*b* is disposed such that an edge portion 139*h* formed on the trailing edge of the nozzle receiver 139. The recessed portion 501*c* is formed such that the nozzle receiver 139 is accommodated.

The toner container 38 is attached to the container tray 501 from the top. Specifically, to attach the toner container 38 to the container tray 501, the nozzle receiver 139 of the toner container 38 is inserted in the recessed portion 501*c*, the step 139*g* formed on the leading edge of the nozzle receiver 139 contacts the first contact surface 501*a*, and the edge portion 139*h* formed on the trailing edge of the nozzle receiver 139 contacts the second contact surface 501*b*. By so doing, the position of the toner container 38 is stabled for attachment. Further, the side surface of the toner container 38 is supported by the tray side surfaces 501*d* of the container tray 501, thereby further stabling the position of the toner container 38.

Next, the container tray 501 having the toner container 36 thereon is moved to the direction Q in FIG. 19. According to this action, before the leading edge of the nozzle section 165 of the transfer nozzle 162 contacts the end surface 140*a* of the shutter 140, projections 502*a* mounted on a bottom surface of the respective side rails 502 and projections 505*a* provided on an upper side of a lower part of the respective guide rails 505 contact as illustrated in FIG. 19, which stops the movement of the container tray 501 in the direction Q in FIG. 19.

Generally, the toner container 38 is made of resin or the like and the toner nozzle 162 is made of metal, and therefore the transfer nozzle 162 has higher rigidity than the toner container 38. If the toner container 38 having lower rigidity contacts the transfer nozzle 162 with a certain force, the nozzle section 165 may partially contact the nozzle receiver 139, which may result in damage to the nozzle receiver 139. In addition, it may be difficult for the nozzle section 165 to slide the shutter 140 in the nozzle receiver 139.

In the present embodiment, the projection 502*a* of the side rails 502 and the projection 505*a* of the guide rails 505 may function as a tray insertion regulating unit. Since the contact of the projection 502*a* of the side rail 502 and the projection 505*a* of the guide rails 505 stops the movement of the container tray 501 in the direction Q, the toner container 38 can be prevented from the above-described damage. Further, the projection 502*a* of the side rail 502 and the projection 505*a* of the guide rail 505 contact before the driving gear 155 of the toner container 38 meshes with the gear 184 provided to the main body 100 of the image forming apparatus 500. The above-described configuration can prevent damage due to adverse tooth bearing that may be caused by contacting the driving gear 155 and the gear 184 on the image forming apparatus 500 with a certain force.

Further, as illustrated in FIG. 8, when the toner container 38 occupies the installation position, the coil spring 169 of the transfer nozzle 162 and the coil spring 142 of the toner container 38 remain compressed. At this time, the restorative forces of these coil springs 142 and the 169 are exerted to the bottom of the toner container 38. With these restorative forces, the moment of force by which the upper portion of the toner container 38 tilts toward the front side of the sheet in FIG. 20 is derived with a meshing position of the driving gear 155 and the gear 184 on the image forming apparatus 500 functioning as a pivot point. However, the container body 138 of the toner container 38 is mounted on the container tray 501 such that the step 139*g* formed at the leading edge of the nozzle receiver 139 of the toner container 38 contacts the first contact surface 501*a* and the edge portion 139*h* of the trailing edge of the nozzle receiver 139, and the top of the toner container 38 is pressed by a container front surface receiving member 503. Therefore, even if this moment of force is generated as illustrated in FIG. 20, the toner container 38 does not tilt actually. The container front surface receiving member 503 has a top surface receiving portion 503*a* guides a top portion of the toner container 38 when attaching the toner container 38 to the container tray 501 so as to accommodate the nozzle receiver 139 into the recessed portion 501*c*.

Figure 22:
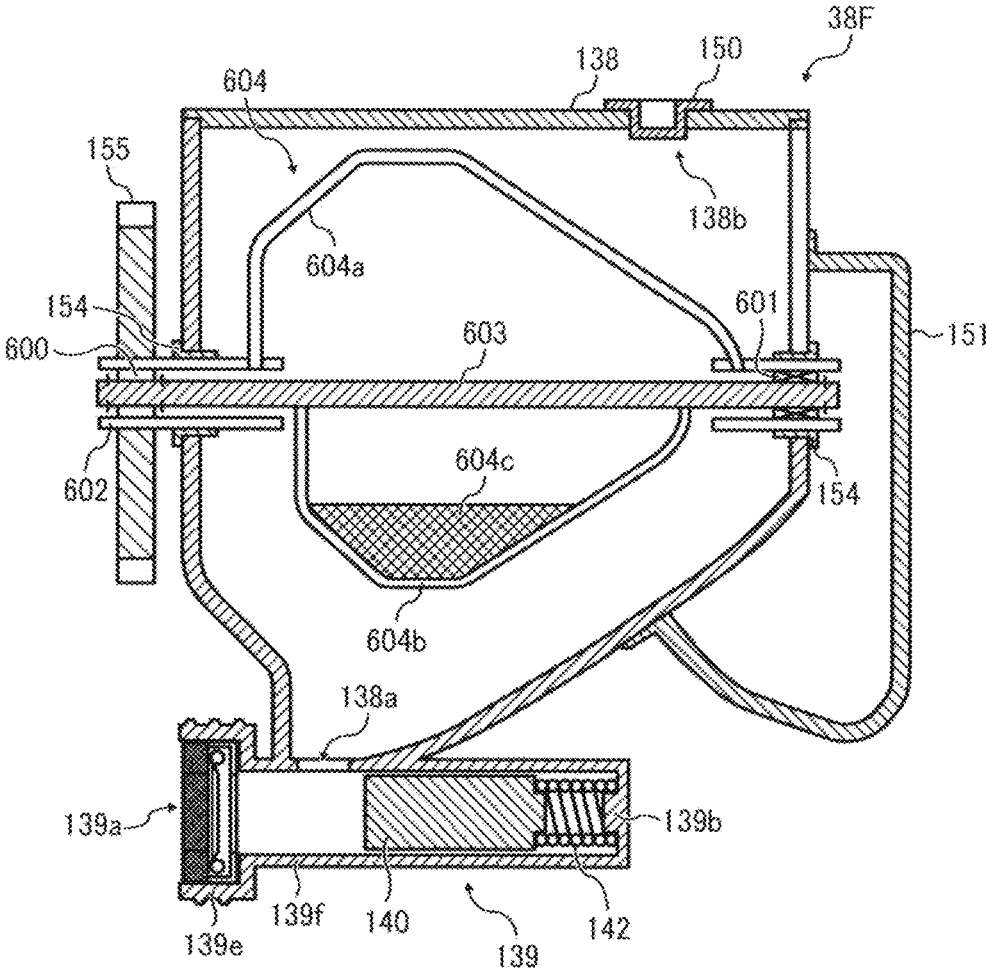
FIG. 22 is a cross-sectional view illustrating a toner container according to yet another embodiment of the present invention.

Further, a description is given of a toner container 38F according to yet another embodiment of the present invention with reference to FIG. 22.

FIG. 22 is a cross-sectional view illustrating the toner container 38F. In this embodiment, components already described with reference to FIG. 4 are denoted by the same reference numerals, and thus detailed description thereof will be hereinafter omitted.

Generally, toner T is fluidized for filling in the toner container 38. Since the toner T is mixed with air before the filling, the toner T in the toner container 38 is de-aired after a predetermined time period has elapsed, thereby reducing the amount of toner powder accommodated in the toner container 38. For example, the container body 138 contains the amount of toner powder in a range of from approximately 70% to approximately 90%.

When a new toner container 38F having the toner T therein is attached to the toner supply device 160 and is used, a large amount of toner T resides near the toner outlet 138*a*. Therefore, without rotating an agitator unit 604 including two agitators to fluidize the toner powder therein, the toner T can be smoothly supplied into the transfer nozzle 162 via the toner outlet 138*a* and the toner inlet 170. By contrast, if the agitators of the agitator unit 604 are forcibly rotated with such a large amount of toner T in the container body 138, a large load capacity of rotation is applied to the agitators of the agitator unit 604 due to the large amount of toner T in the container body 138.

Therefore, the toner container 38F according to the present embodiment is configured to include a torque limiter 600 located in the driving force transmission path from the driving gear 155 to the agitator unit 604 disposed in the interior of the container body 138.

Specifically, the torque limiter 600 provided in the toner container 38F has the same concentricity as the outer circumference of a rotation shaft 603 that is a central axis functioning as a rotary member to which the small agitator 604*b* is fixed, and is disposed at one end portion of a hollow shaft 602 to which the large agitator 604*a* is fixed. Then, the outer circumference of the hollow shaft 602 is fixed to the driving gear 155. A bearing 601 is disposed at the other end portion of the hollow shaft 602. It is to be noted that the torque limiter 600 may be applicable to any known configuration in which the torque limiter 600 can be disposed at a position having the same concentricity as the rotation shaft 603.

The torque limiter 600 limits or controls transmission of a rotation force to the agitator unit 604, and the torque of the torque limiter 600 is set to provide the functions (1) and (2).

(1) When the toner T is sufficiently filled in the container body 138, a large amount of load is applied to the agitators 604*a* and 604*b* of the agitator unit 604. In this case, the torque limiter 600 restricts transmission of the driving force from the toner supply device 160 to the small agitator 604*b* and rotates the large agitator 604*a* alone. The small agitator 604*b* remains unrotated.

(2) When the toner T in the container body 138 is consumed, a small amount of load is applied to the agitators 604*a* and 604*b* of the agitator unit 604. In this case, the torque limiter 600 transmits the driving force to both the large agitator 604*a* and the small agitator 604*b*.

Further, as illustrated in FIG. 22, the agitator unit 604 further includes a planar portion 604*c* at the leading edge of the small agitator 604*b*. The planar portion 604*c* that functions as an adjusting member to adjust or control the amount of rotation load of the agitator unit 604. The small agitator 604*b* having the planar portion 604*c* can increase the load to rotate the small agitator 604*b* according to the size of the planar portion 604*c*. A typical torque limiter (e.g., the torque limiter 600) has a load torque value as a default value to block transmission of the driving force. For example, when the small agitator 604*b* is controlled to whether rotate or remain unrotated according to the flowability of toner to be used, the size of the planar portion 604*c* can be changed appropriately. According to the change of the size of the planar portion 604*c*, the load torque to rotate the small agitator 604*b* can be adjusted to whether go above or keep below the above-described load torque value.

It is to be noted that, in the above-described embodiments, high toner flowability can easily cause toner dispersion due to attachment or detachment of the toner supply device.

Known indexes of toner flowability are the increasing cohesion [%], the poured apparent particle density [g/cm$^3$], and so on. Toner used to contain in the toner containers 38, 38A, 38B, 38D, 38E, and 38F includes particles having about 5.5 [μm] of mean volume diameter, about 13% of increasing cohesion, and about 0.36 [g/cm$^3$] of poured apparent particle density, to which about 3.3 [mass] of silica and about 0.6 [mass] of titan are added. This toner can be fixed to a recording medium with about 120 degrees Celsius of heat capacity, which has good low temperature fixability.

The above-described toner is not limited thereto. For example, the above-described toner containers 38, 38A, 38B, 38D, 38E, and 38F are applicable to toner having particles having about 4.5 [μm] of mean volume diameter, about 18% of increasing cohesion, and about 0.38 [g/cm$^3$] of poured apparent particle density, to which about 2.3 [mass] of silica and about 0.7 [mass] of titan are added or toner having parameter values different from the above-described parameters.

Toner is manufactured by using known polymerization method or grinding method. Particle size distribution is measured with a Coulter counter method by using Coulter Counter TA-II or Coulter Multisizer II (both manufactured by Beckman Coulter Inc.). The increasing cohesion of toner is measured under the condition in which the temperature is 04 degrees Celsius [° C.] and the humidity is 72% by using Powder Tester (manufactured by Hosokawa Micron Corporation). The other conditions of the measurement were described in Table 1 below.

TABLE 1

| Item | Unit | Standard Condition Value | Current Condition Value |
|---|---|---|---|
| Upper Sieve | μm | 75 | 75 |
| Middle Sieve | μm | 45 | 45 |
| Lower Sieve | μm | 20 | 20 |
| Amplitude of Vibration | mm | 1 | 1.5 |
| Amount of Sample Powder | g | 2.00 ± 0.01 | 2.00 ± 0.01 |
| Duration of Vibration | second | 10 | 30 |

After measurement, the cohesion [%] of toner (powder) is obtained by using the following equations (a) through (c):

Powder mass remaining in an upper sieve [%]×1 . . . (a),

Powder mass remaining in a middle sieve [%]×0.6 . . . (b),

Powder mass remaining in a lower sieve [%]×0.2 . . . (c), and

Cohesion of toner (powder) [%]=(a)+(b)+(c).

The measurement results of toner cohesion [Unit: percent, %] are described in Table 2. In Table 2, toner types D and E were evaluated to have low flowability.

TABLE 2

| Toner Type | Standard Condition Measurement | 1st Measurement under Current Condition | 2nd Measurement under Current Condition |
|---|---|---|---|
| A | 11.4 | 11.2 | 11.6 |
| B | 12.9 | 12.6 | 13.2 |
| C | 18.4 | 17.2 | 19.6 |
| D | 56 | 54.2 | 57.8 |
| E | 64.9 | 63.8 | 66 |

The poured apparent particle density is obtained by passively filling and leveling toner (powder) in the toner container and calculating by dividing the mass of the toner by the volume of the toner container.

Toner with high flowability may easily cause toner scattering. However, the toner container and the toner supply device according to the present embodiment are configured to supply toner to the toner supply device inside the toner container. Therefore, this configuration is effective for toner with low flowability and more effective for toner with high flowability.

The above-described embodiments are illustrative and do not limit the present invention. Thus, numerous additional modifications and variations are possible in light of the above teachings. For example, elements at least one of features of different illustrative and exemplary embodiments herein may be combined with each other at least one of substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of the present invention may be practiced otherwise than as specifically described herein.

What is claimed is:

1. A powder container comprising:

a container body to accommodate powder for image forming therein, the container body including an outlet at a bottom thereof through which the powder is supplied to a powder supply device and being detachably attachable to a container receiver included in an image forming apparatus;

a rotary member disposed in an interior of the container body;

an agitator supported by the rotary member to rotate by means of a driving force transmitted from the image forming apparatus; and a powder receiver disposed at a lower portion of the container body to receive a transport tube, the powder receiver comprising:

a nozzle receiver opening to guide a transport tube to a position below the outlet;

an opening-closing member to open and close the nozzle receiver opening;

a container-side biasing member to bias the opening-closing member in a direction to close the opening-closing member;

a container opening-closing member supporter to accommodate the opening-closing member and the container-side biasing member and be biased toward the powder receiver opening-closing member;

a step to contact a first contact surface of the container receiver due to a restorative force of the container-side biasing member upon attachment of the powder container to the powder supply device; and an end portion to contact a second contact surface of the container receiver due to the restorative force of the container-side biasing member upon the powder container being attached to the powder supply device, the powder container further comprising a torque limiter to control transmission of the driving force to the agitator, wherein the rotary member includes multiple rotary members, wherein the agitator includes multiple agitating members supported by the respective rotary members, wherein the torque limiter is located between multiple rotary members.

2. The powder container according to claim 1, wherein torque of the torque limiter is set to restrict transmission of the driving force from the image forming apparatus to a smaller agitating member of the multiple agitating members and to solely rotate a larger agitating member of the multiple agitating members upon the powder sufficiently filled in the container body.

3. The powder container according to claim 2, wherein the torque of the torque limiter is set to transmit the driving force to both the smaller agitating member and the larger agitating member upon the powder in the container body being consumed.

4. The powder container according to claim 1, wherein at least one of the agitating members comprise an adjusting member to adjust an amount of rotation load of the at least one of the agitating members.

5. An image forming apparatus comprising:

the powder container according to claim 1;

the powder supply device including a transfer nozzle having a toner inlet, the powder supply device to be inserted into the powder container to receive and supply powder from the powder container via an outlet of the powder container and the toner inlet;

a powder transport path connected to the transfer nozzle and a developing device to transport powder supplied in the transfer nozzle to a powder supplying target; and the container receiver to hold the powder container therein.

6. The image forming apparatus according to claim 5, wherein the powder container is disposed outside the developing device.

7. The image forming apparatus according to claim 5, further comprising a container front surface receiving member to contact an upper portion of the powder container upon attachment of the powder container.

8. The image forming apparatus according to claim 7, wherein the powder container is disposed outside the developing device.

9. The image forming apparatus according to claim 5, further comprises guide rails, each of which mounted on an inner wall thereof, wherein the container receiver comprises side rails to guide the container receiver to slide along the guide rails.

10. The image forming apparatus according to claim 9, wherein the powder supply device comprises a gear, the powder container includes a drive transmission member, the container receiver further comprises a first projection mounted on each of the side rails and a second projection mounted on each of the guide rails, the first projection contacts the second projection before the drive transmission member of the powder container meshes with the gear of the powder supply device.

11. The powder container according to claim 1, wherein the powder container includes toner therein.

12. The powder container according to claim 11, wherein the powder container includes carrier therein.

13. A powder container for use with an image forming apparatus, the powder container comprising:

a container body to accommodate powder for image forming therein;

an outlet at a bottom of the container body closed with a shutter biased to close the outlet;

a supply inlet at a top of the container body closed with a seal;

a handle to grip while attaching and detaching the powder container to and from the image forming apparatus; and a member to transmit a driving force from the image forming apparatus to a shaft of an agitator, and disposed on a side of the powder container which is opposite to a side of the handle, wherein the agitator includes a first agitator and a second agitator, a length of the second agitator from the shaft is longer than a length of the first agitator from the shaft, the powder container further comprising a torque limiter to control transmission of the driving force to the agitator, wherein the agitators are supported by respective rotary members, and wherein the torque limiter is located between the multiple rotary members.

14. The powder container according to claim 13, wherein the length of the second agitator from the shaft is a length which the second agitator does not make contact with an interior of the container body.

15. The powder container according to claim 13, further comprising, a powder receiver disposed at a bottom of the container body to guide a transport tube to transport the powder in the container body via the outlet into the image forming apparatus.

16. The powder container according to claim 15, wherein the powder receiver comprises:

a nozzle receiver opening to guide the transport tube to a position below the outlet; and a supporter to guide an opening and closing movement of the shutter.

17. The powder container according to claim 13, wherein the powder container includes toner therein.

18. The powder container according to claim 17, wherein the powder container includes carrier therein.

19. An image forming apparatus comprising:

a powder container which includes:

a container body to accommodate powder for image forming therein, the container body including an outlet at a bottom thereof through which the powder is supplied to a powder supply device and being detachably attachable to a container receiver included in an image forming apparatus;

a rotary member disposed in an interior of the container body;

an agitator supported by the rotary member to rotate by means of a driving force transmitted from the image forming apparatus; and a powder receiver disposed at a lower portion of the container body to receive a transport tube, the powder receiver comprising:

a nozzle receiver opening to guide a transport tube to a position below the outlet;

an opening-closing member to open and close the nozzle receiver opening;

a container-side biasing member to bias the opening-closing member in a direction to close the opening-closing member;

a container opening-closing member supporter to accommodate the opening-closing member and the container-side biasing member and be biased toward the powder receiver opening-closing member;

a step to contact a first contact surface of the container receiver due to a restorative force of the container-side biasing member upon attachment of the powder container to the powder supply device; and an end portion to contact a second contact surface of the container receiver due to the restorative force of the container-side biasing member upon the powder container being attached to the powder supply device, the image forming apparatus further comprising:

the powder supply device including a transfer nozzle having a toner inlet, the powder supply device to be inserted into the powder container to receive and supply powder from the powder container via an outlet of the powder container and the toner inlet;

a powder transport path connected to the transfer nozzle and a developing device to transport powder supplied in the transfer nozzle to a powder supplying target;

the container receiver to hold the powder container therein; and guide rails, each of which mounted on an inner wall thereof, wherein the container receiver comprises side rails to guide the container receiver to slide along the guide rails.

* * * * *